US008231288B2

(12) United States Patent
Kawamura et al.

(10) Patent No.: US 8,231,288 B2
(45) Date of Patent: Jul. 31, 2012

(54) ROTARY SHAFT LOCKING DEVICE AND RECORDING APPARATUS HAVING THE SAME

(75) Inventors: Satoshi Kawamura, Shiojiri (JP); Yu Shinagawa, Shiojiri (JP); Atsuhiko Takeuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 444 days.

(21) Appl. No.: 12/436,928

(22) Filed: May 7, 2009

(65) Prior Publication Data

US 2009/0279933 A1 Nov. 12, 2009

(30) Foreign Application Priority Data

May 8, 2008 (JP) ..... 2008-122036
Aug. 20, 2008 (JP) ..... 2008-212187

(51) Int. Cl.
*B41J 11/00* (2006.01)
*B41J 13/26* (2006.01)
*B65H 5/00* (2006.01)
*B65H 5/04* (2006.01)

(52) U.S. Cl. ..... 400/579; 400/630; 400/636; 400/637; 399/395; 271/264; 271/272; 271/275; 271/314; 74/10 R

(58) Field of Classification Search ..... 400/579, 400/630, 636–637; 399/395; 271/264, 272, 271/275, 314; 74/10 R
See application file for complete search history.

(56) References Cited

U.S. PATENT DOCUMENTS

| | | | | |
|---|---|---|---|---|
| 632,232 | A | 9/1899 | Brown | |
| 922,138 | A | 5/1909 | Hendler | |
| 2,887,201 | A | 5/1959 | Willis | |
| 3,194,366 | A | 7/1965 | Hensel | |
| 3,692,161 | A | 9/1972 | Katsuren et al. | |
| 5,934,810 | A | 8/1999 | Choi et al. | |
| 2007/0085258 | A1 * | 4/2007 | Iwago et al. | 271/3.14 |

FOREIGN PATENT DOCUMENTS

| | | |
|---|---|---|
| JP | 10-331941 | 12/1998 |
| JP | 2007-084224 | 4/2007 |

OTHER PUBLICATIONS

U.S. Appl. No. 12/437,678, filed May 8, 2009, Shinagawa et al.
U.S. Appl. No. 12/437,678, mailed Jan. 3, 2012, Office Action.

* cited by examiner

*Primary Examiner* — Michael G Lee
*Assistant Examiner* — Laura Gudorf
(74) *Attorney, Agent, or Firm* — Workman Nydegger

(57) ABSTRACT

A rotary shaft locking device includes a locking unit having a transmission gear receiving rotary torque from a power source, transmitting rotary torque to a rotary shaft as the transmission gear receives rotary torque from the power source, and locking the rotary shaft as transmission of rotary torque from the power source is cut off, and a first planetary gear and a second planetary gear provided to be meshed with a sun gear and to planetarily move around the sun gear, and displaced between a meshed position and an unmeshed position so as to be meshed with and separated from the transmission gear. The locking unit locks the rotary shaft for a power cutoff time which occurs when the rotation direction of the sun gear is switched and for which the transmission gear is not meshed with both the first planetary gear and the second planetary gear.

5 Claims, 19 Drawing Sheets

ROTARY SHAFT LOCKING DEVICE AND RECORDING APPARATUS HAVING THE SAME

BACKGROUND

1. Technical Field

The present invention relates to a locking device that locks and unlocks a rotary shaft. The present invention also relates to a recording apparatus, such as a facsimile machine or a printer, having the locking device.

2. Related Art

In a recording apparatus, such as a facsimile machine or a printer, as a control method that eliminates a skew (oblique movement) of a sheet, there is known a skew removal control using a "nip and release method", as described in JP-A-2007-84224.

In the skew removal control, a downstream roller and an upstream roller are used. Specifically, a leading end of a sheet is nipped by the downstream roller, then fed by a predetermined amount to a downstream side, and subsequently released to an upstream side from the downstream roller by backward rotation of the downstream roller while the upstream roller stops. When this happens, the sheet is bent between the upstream roller and the downstream roller, and the leading end of the sheet follows the downstream roller due to the return behavior of the sheet. As a result, a skew is effectively corrected.

However, if the skew removal control is performed for a rigid (hard) sheet, such as a thick sheet or the like, when the leading end of the sheet is released from the downstream roller, a force to rotate the upstream roller becomes large, and in some instances, the upstream roller is rotated backward. For this reason, a skew may not be satisfactorily eliminated.

In order to solve this problem, as described in JP-A-10-331941, a clutch that permits rotation only in one direction is interposed between the upstream roller and a motor for driving the upstream roller so as to prevent backward rotation of the upstream roller. That is, it is necessary to lock the upstream roller so as not to rotate backward.

In a recording apparatus that performs recording on both sides of the sheet, the roller may rotate backward so as to return the sheet toward the upstream side. In this case, the above-described clutch that permits rotation only in one direction cannot be applied as it is. Accordingly, there is a need for a locking device that can permit rotation forward and backward, and as occasion demands, reliably prevent backward rotation (rotation lock).

When the upstream roller and the downstream roller use a common driving motor, in order to perform the skew removal control using a nip and release method, while the downstream roller rotates backward by a predetermined amount, the upstream roller needs to be locked so as not to rotate backward. There is also a need for a locking device that can satisfy such an operation condition.

SUMMARY

An advantage of some aspects of the invention is that it provides a locking device capable of permitting a rotary shaft to rotate forward and backward, and as occasion demands, locking the rotary shaft. Another advantage of some aspects of the invention is that it provides a locking device capable of putting a rotary shaft in a lock state when the rotation direction of the driving motor is switched.

According to a first aspect of the invention, a rotary shaft locking device includes a locking unit having a transmission gear receiving rotary torque from a power source, transmitting rotary torque to a rotary shaft as the transmission gear receives rotary torque from the power source, and locking the rotary shaft as transmission of rotary torque from the power source is cut off, and a first planetary gear and a second planetary gear provided to be meshed with a sun gear and to planetarily move around the sun gear, and displaced between a meshed position and an unmeshed position so as to be meshed with and separated from the transmission gear by the planetary movement. The first planetary gear is displaced to the meshed position in accordance with rotation of the sun gear in a first direction to thereby rotate the transmission gear, and is displaced to the unmeshed position in accordance with rotation of the sun gear in a second direction. The second planetary gear is displaced to the meshed position in accordance with rotation of the sun gear in the second direction, to thereby rotate the transmission gear in a direction opposite a rotation direction by the first planetary gear, and is displaced to the unmeshed position in accordance with rotation of the sun gear in the first direction. The locking unit locks the rotary shaft for a power cutoff time which occurs when the rotation direction of the sun gear is switched and for which the transmission gear is not meshed with both the first planetary gear and the second planetary gear.

In this aspect, the locking unit locks the rotary shaft for the power cutoff time which occurs when the rotation direction of the sun gear is switched and for which the transmission gear is not meshed with both the first planetary gear and the second planetary gear. Therefore, while the rotary shaft can be configured to rotate forward and backward, when the rotation direction is switched, the rotary shaft can be locked.

According to a second aspect of the invention, in the rotary shaft locking device according to the first aspect of the invention, a displacement when the first planetary gear is displaced between the meshed position and the unmeshed position may be different from a displacement when the second planetary gear is displaced between the meshed position and the unmeshed position.

In this aspect, the displacement of the first planetary gear is different from the displacement of the second planetary gear. Therefore, the power cutoff time, that is, a rotary shaft lock time can vary between when the sun gear is switched from forward rotation to backward rotation and when the sun gear is switched from backward rotation to forward rotation. An appropriate apparatus configuration can be realized in accordance with the purpose.

According to a third aspect of the invention, in the rotary shaft locking device according to the first or second aspect of the invention, the locking unit may include a clutch member provided to rotate integrally with the rotary shaft and to be displaced along the axis of the rotary shaft, a locking member provided in a fixed state to be engaged with the clutch member so as to regulate rotation of the clutch member, an urging member urging the clutch member toward the locking member, and a torque transmission member having a boss integrally having the transmission gear, the boss being loosely inserted into a cam groove provided at an outer circumferential portion of the clutch member, and transmitting rotary torque to the clutch member through the boss. The boss may be displaced within the cam groove when the torque transmission member is switched between rotation and stop, such that an unlock state where the boss separates the clutch member from the locking member against an urging force of the urging member and a lock state where the boss permits displacement of the clutch member to engage the clutch member with the locking member are switched.

In this aspect, the boss is displaced within the cam groove when the torque transmission member which transmits torque to the rotary shaft is switched between rotation and stop, such that the clutch unit is switched between the unlock state where rotary torque is transmitted to the clutch member (that is, the rotary shaft) and the lock state where the clutch member (rotary shaft) is locked. Therefore, the clutch unit can be configured with a small number of parts and at low cost.

According to a fourth aspect of the invention, a recording apparatus includes a recording unit performing recording on a recording medium, a first feed roller provided on an upstream side from the recording unit in a transport path of the recording medium to transport the recording medium toward the recording unit, and a second feed roller provided on an upstream side from the first feed roller in the transport path of the recording medium to transport the recording medium toward the first feed roller. The first feed roller and the second feed roller are driven to rotate by a common driving motor. The locking device according to any one of the first to third aspects of the invention is provided in a transmission path of rotary torque from the driving motor to the second feed roller. The locking device is configured to lock the rotary shaft of the second feed roller.

In this aspect, the second feed roller provided on an upstream side from the first feed roller can rotate forward and backward, and when the rotation direction is switched, can be locked by the locking device according to any one of the first to third aspects of the invention. Therefore, while the recording medium can be transported toward both the upstream side and the downstream side, when the skew removal control using a nip and release method is performed, the backward rotation of the second feed roller can be suppressed. As a result, the skew of the recording medium can be appropriately removed.

According to a fifth aspect of the invention, in the recording apparatus according to the fourth aspect of the invention, the sun gear may be configured to receive rotary torque from the driving motor through the first feed roller. When the first feed roller rotates forward to transport the recording medium toward the downstream side, rotary torque for forward rotation may be transmitted to the second feed roller through the first planetary gear such that the second feed roller transports the recording medium toward the downstream side. A displacement when the first planetary gear is displaced from the unmeshed position to the meshed position as the first feed roller is switched from backward rotation to forward rotation may be set so as to be smaller than a displacement when the second planetary gear is displaced from the unmeshed position to the meshed position as the first feed roller is switched from forward rotation to backward rotation.

In this aspect, when the first feed roller is switched from backward rotation to forward rotation, the displacement until the first planetary gear returns to the meshed position is set so as to be smaller than the displacement when the second planetary gear is displaced from the unmeshed position to the meshed position. Therefore, after the first feed roller is switched from backward rotation to forward rotation, the second feed roller can rapidly start to rotate forward, without causing a large time lag.

That is, the first feed roller is driven to rotate backward in a state where the second feed roller has stopped. In this way, after the skew removal control is performed by using the first feed roller and the second feed roller, when the first feed roller is switched to forward rotation again, a time for which the first feed roller rotates forward in a state where the second feed roller has stopped can be shortened. As a result, the recording medium is stretched between the second feed roller and the first feed roller, and thus the recording medium can be prevented from being damaged.

According to a sixth aspect of the invention, in the recording apparatus according to the fourth or fifth aspect of the invention, skew removal control may be executed that includes a first step, in which the first feed roller and the second feed roller are rotated forward by forward rotation of the driving motor, and the leading end of the recording medium is adjusted to the downstream side from the first feed roller by a predetermined amount, and a second step, in which the driving motor is switched from forward rotation to backward rotation, the first feed roller rotates backward in a state where the locking unit locks the rotary shaft of the second feed roller, and the leading end of the recording medium is released to the upstream side from the first feed roller. In the second step, the driving motor may rotate backward until the second planetary gear is displaced from the unmeshed position to the meshed position, and the first feed roller and the second feed roller may rotate backward to return the leading end of the recording medium to the upstream side from the first feed roller by a predetermined amount.

In the skew removal control using a so-called nip and release method, if the driving motor is switched to forward rotation subsequent to the second step, in which the leading end of the recording medium is released to the upstream side from the first feed roller, the first feed roller precedingly rotates forward until the first planetary gear is switched from the unmeshed position to the meshed position.

For this reason, if the recording medium is engaged with the first feed roller at the end of the second step, when the driving motor is switched to forward rotation, a force to feed the recording medium from the first feed roller toward the downstream side is immediately applied to the recording medium. Then, only the first feed roller precedingly rotates forward, such that tension is applied to the recording medium between the first feed roller and the second feed roller. As a result, transport accuracy is degraded, and recording quality is deteriorated.

In contrast, according to this aspect, the leading end of the recording medium returns to the upstream side from the first feed roller by a predetermined amount at the end of the second step, that is, the recording medium is not caught between the first feed roller and the second feed roller. Therefore, when the driving motor is switched to forward rotation subsequent to the second step, not as described above, no tension is applied to the recording medium, and thus recording quality can be prevented from being deteriorated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
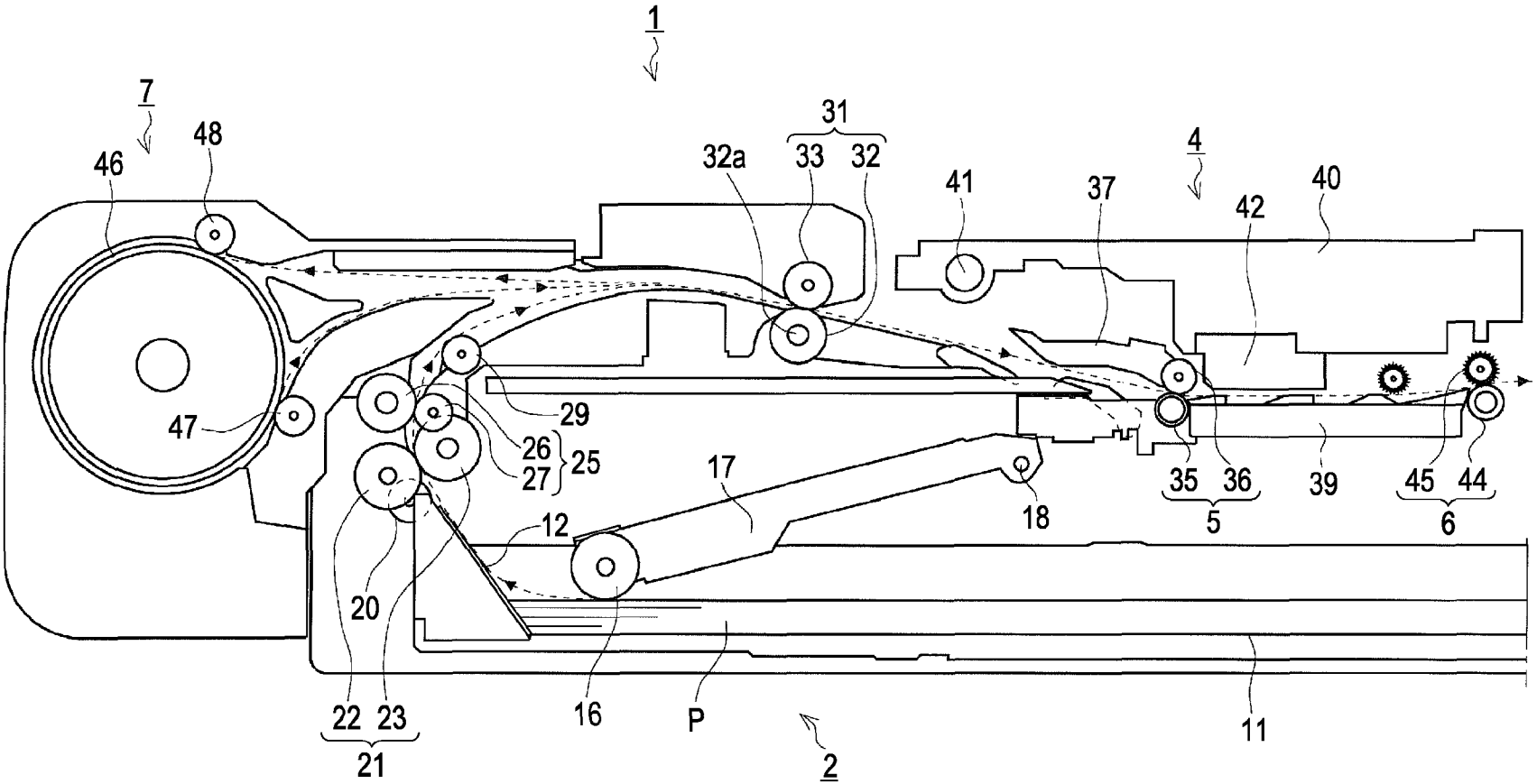
FIG. 1 is a side sectional view showing a sheet transport path of a printer according to an embodiment of the invention.
Figure 2:
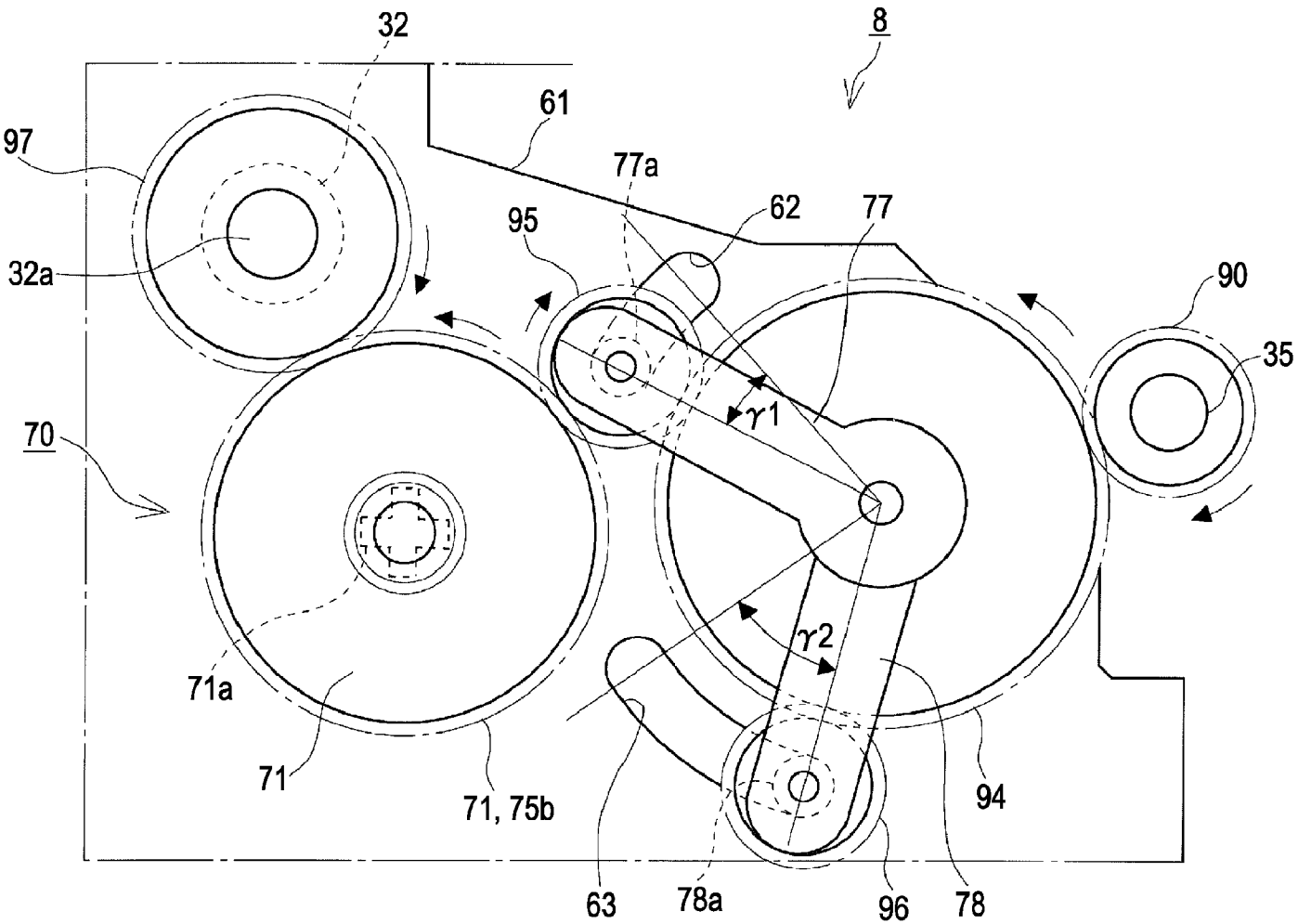
FIG. 2 is a front view of a locking device according to a first embodiment of the invention.
Figure 3:
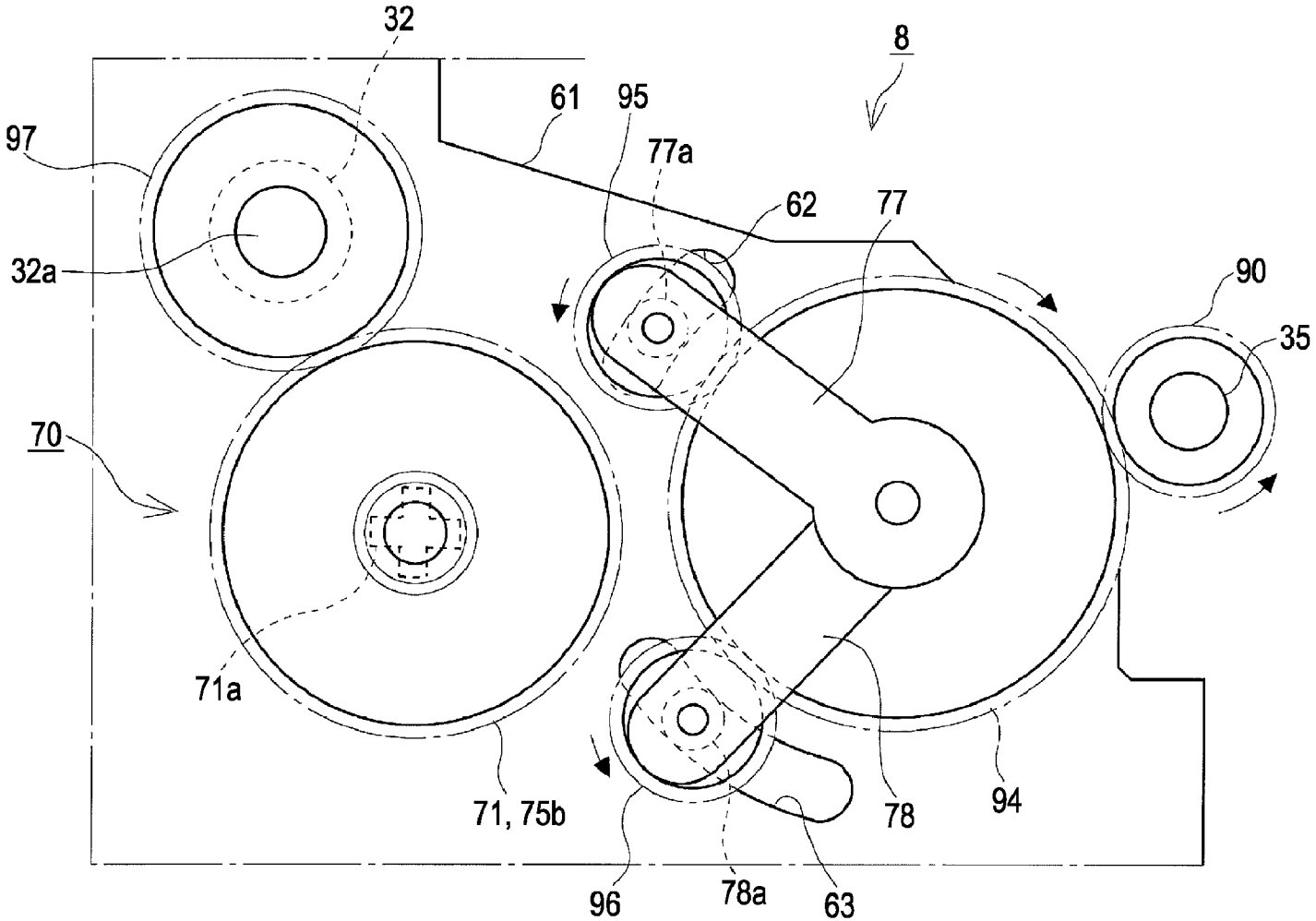
FIG. 3 is a front view of a locking device according to a first embodiment of the invention.
Figure 4:
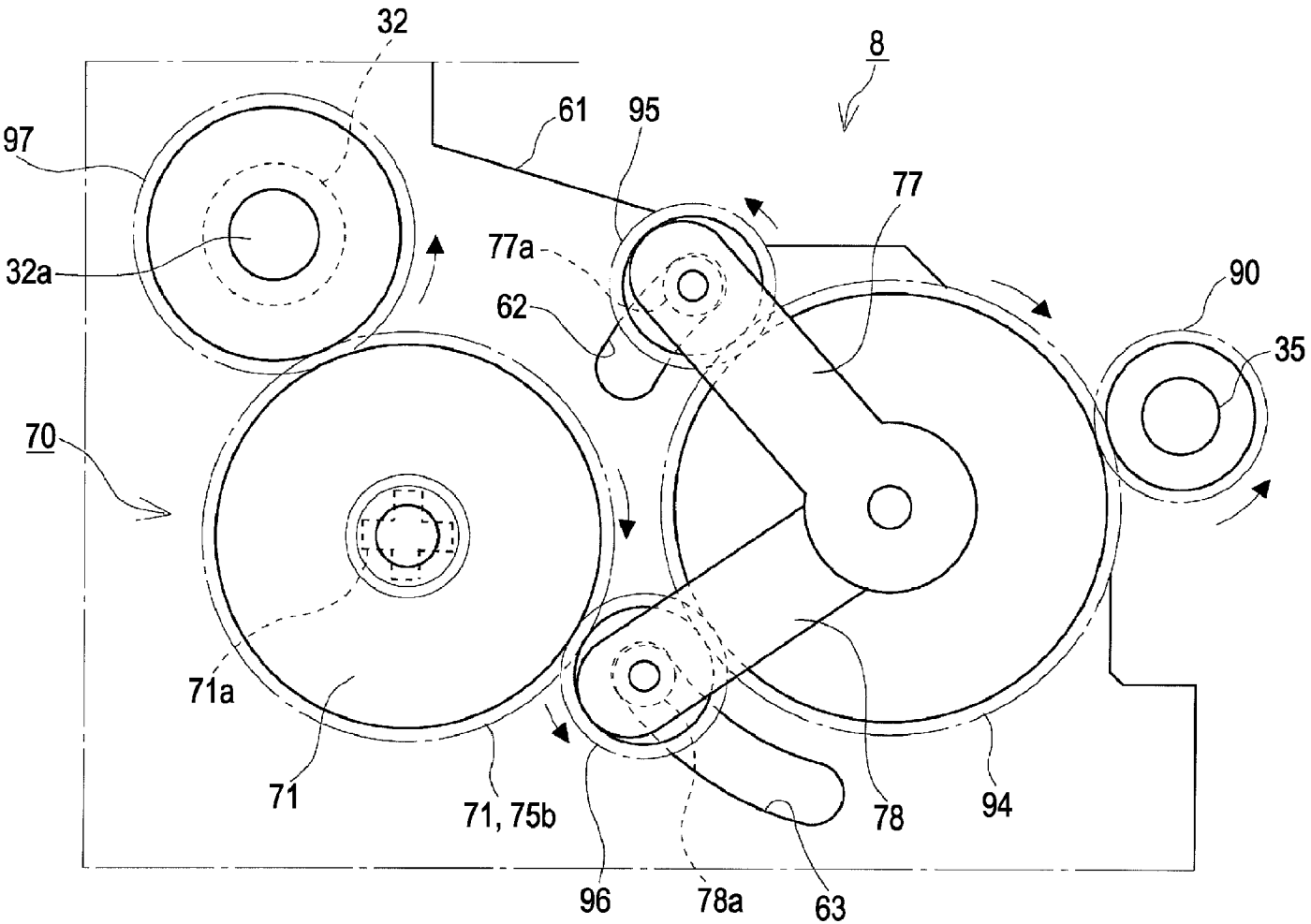
FIG. 4 is a front view of a locking device according to a first embodiment of the invention.
Figure 5:
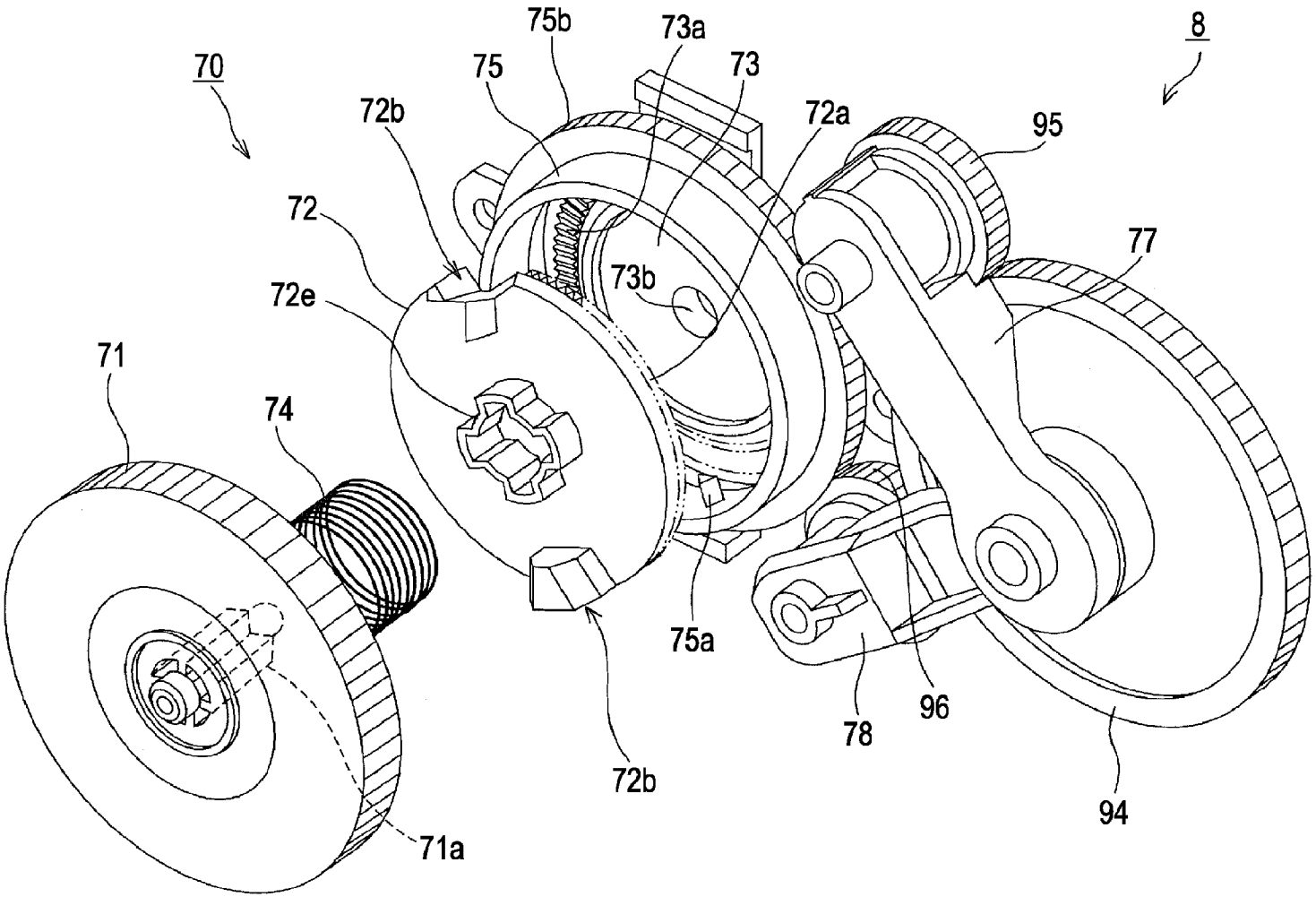
FIG. 5 is an exploded perspective view of a locking unit.
Figure 6:
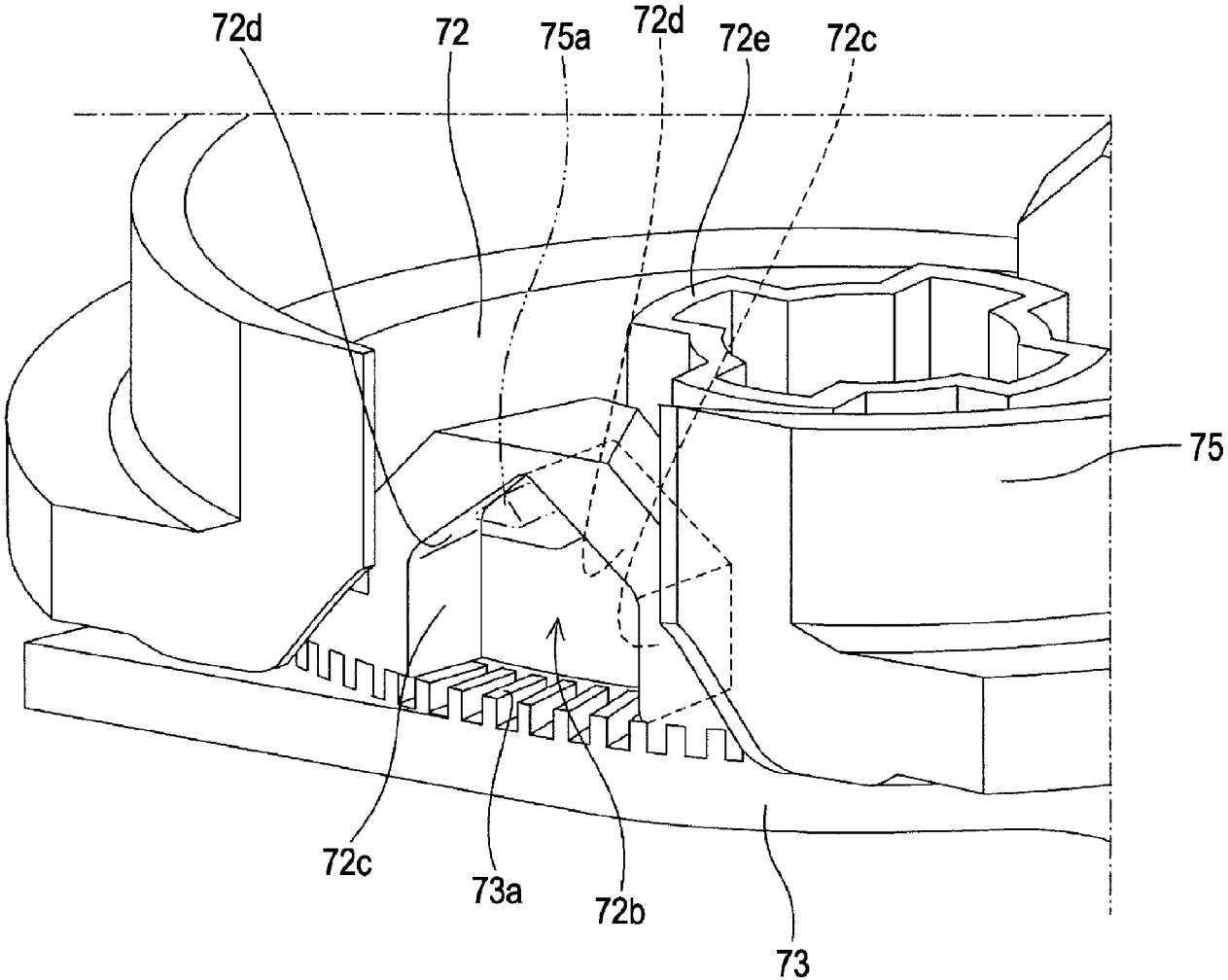
FIG. 6 is an enlarged perspective view showing essential parts of a locking unit.
Figure 7A:
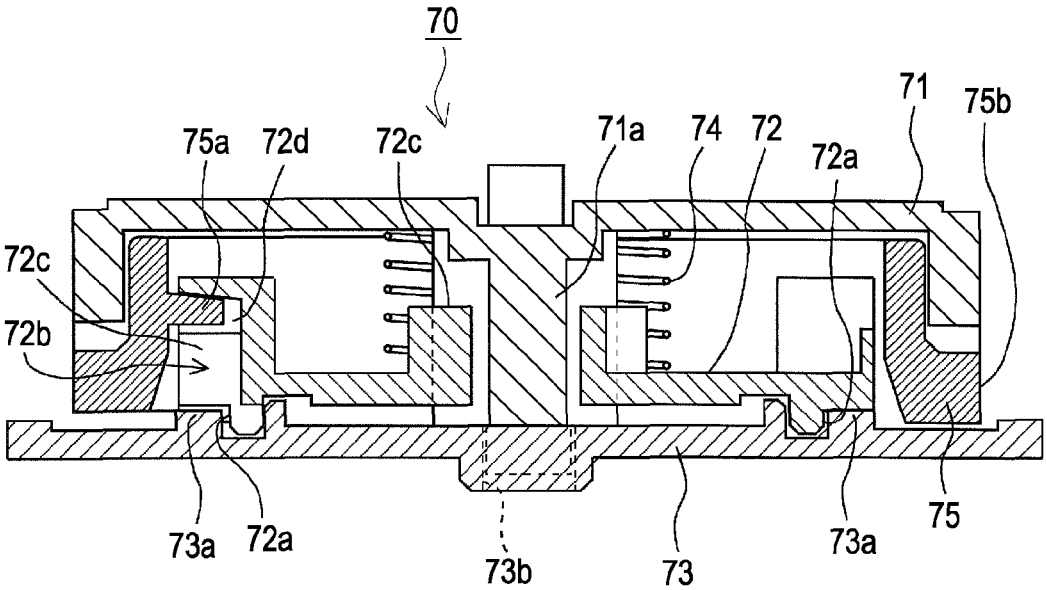
FIGS. 7A and 7B are sectional views of a locking unit.
Figure 7B:
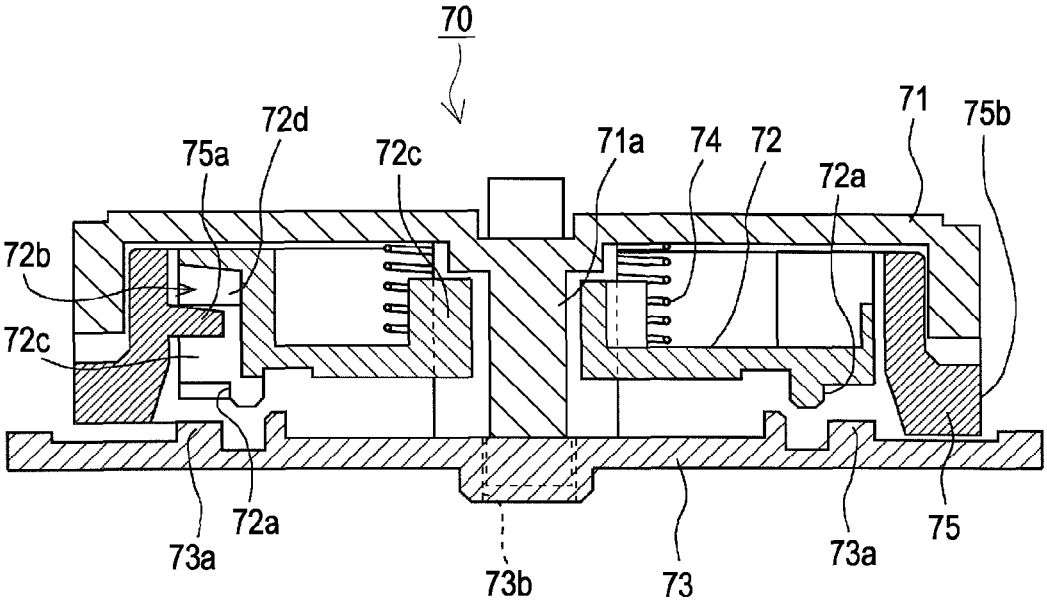
Figure 8A:
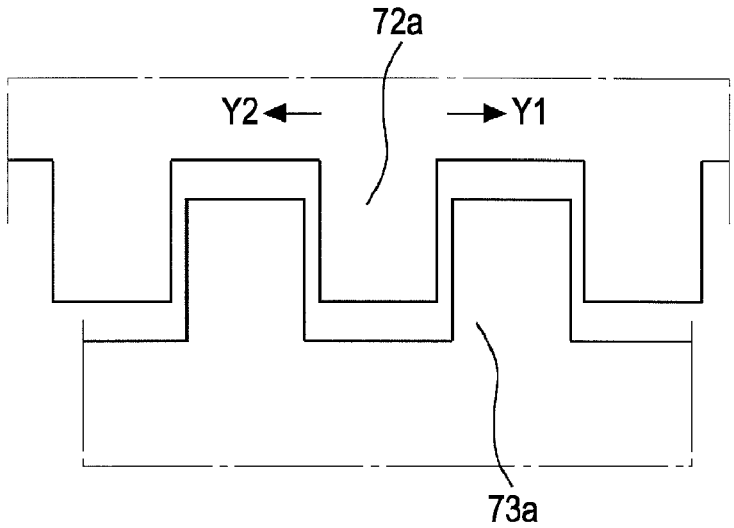
FIGS. 8A to 8C are diagrams showing various embodiments of mesh teeth.
Figure 8B:
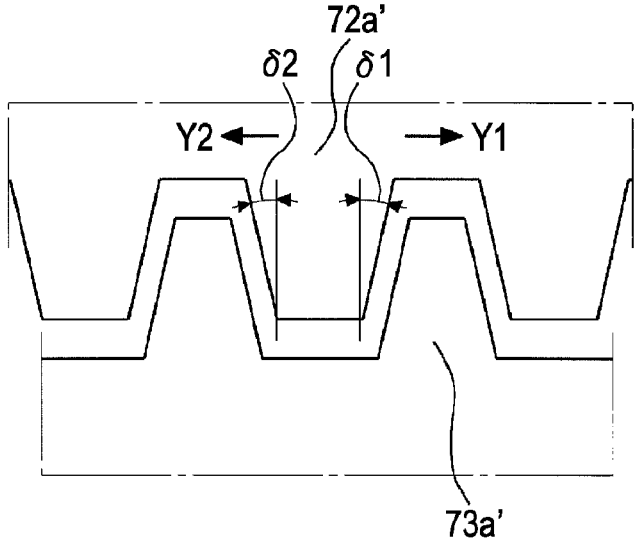
Figure 8C:
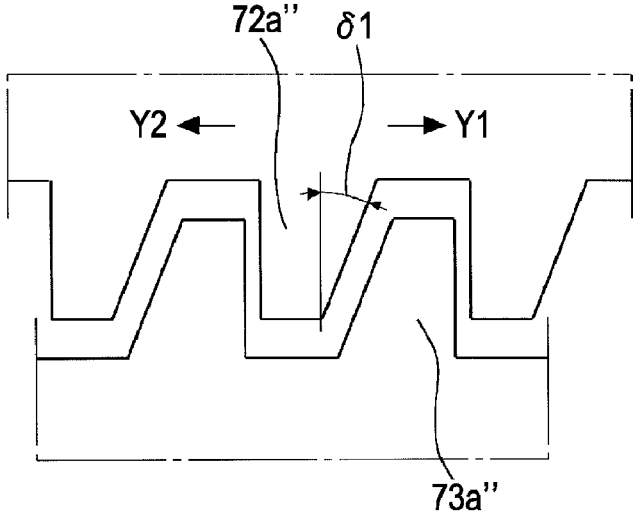

Hereinafter, embodiments of the invention will be described with reference to FIGS. 1 to 15B. FIG. 1 is a side sectional view showing a sheet transport path of an ink jet printer (hereinafter, referred to as "printer") which is an embodiment of a recording apparatus. FIGS. 2 to 4 are front views of a locking device 8 according to a first embodiment of the invention. FIG. 5 is an exploded perspective view of a locking unit 70. FIG. 6 is an enlarged perspective view (partial sectional view) showing essential parts of the locking unit 70. FIGS. 7A and 7B are sectional views of the locking unit 70 taken along a plane parallel to the axis of a rotary shaft 71*a*. FIGS. 8A to 8C are diagrams showing various embodiments of mesh teeth.

Figure 9:
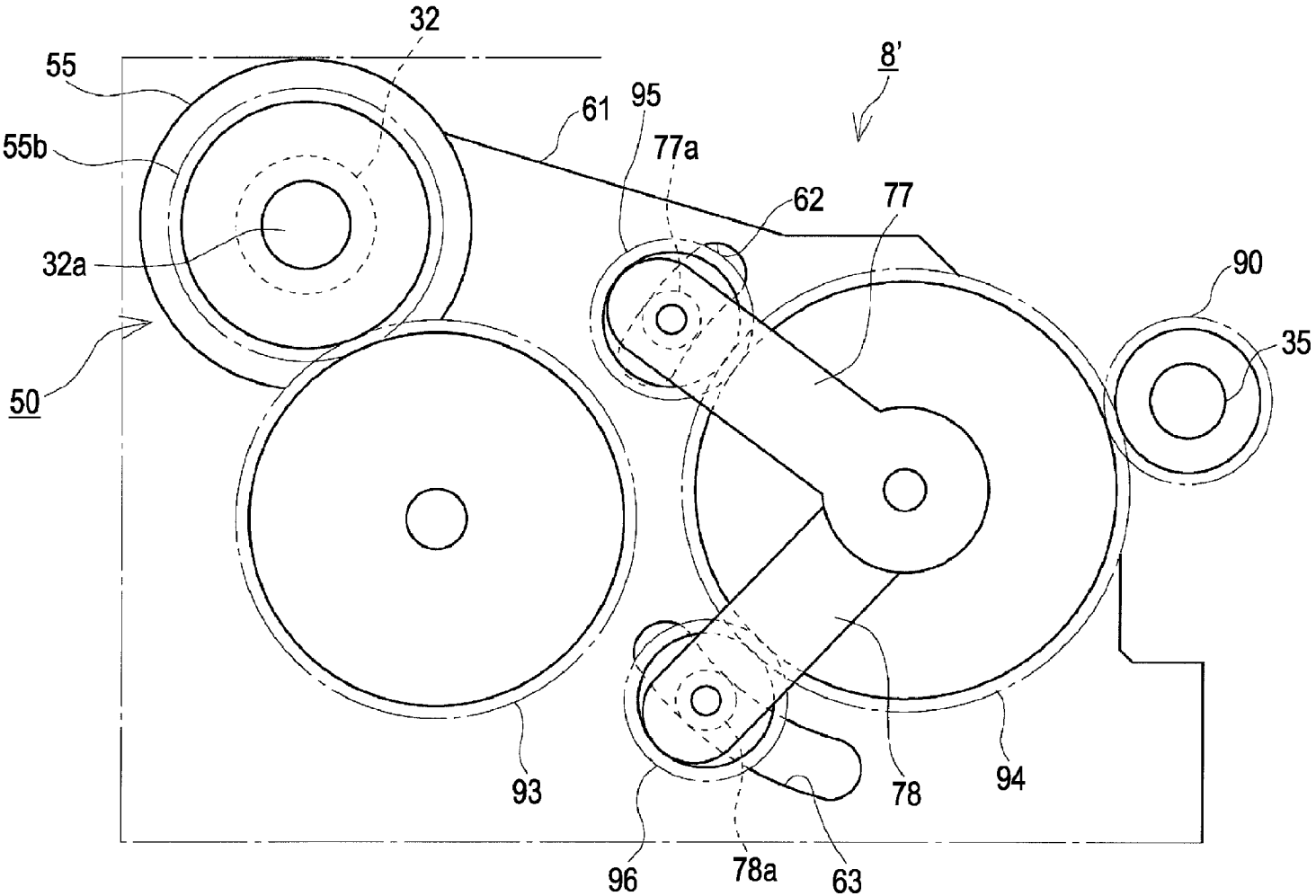
FIG. 9 is a front view of a locking device according to a second embodiment of the invention.
Figure 10:
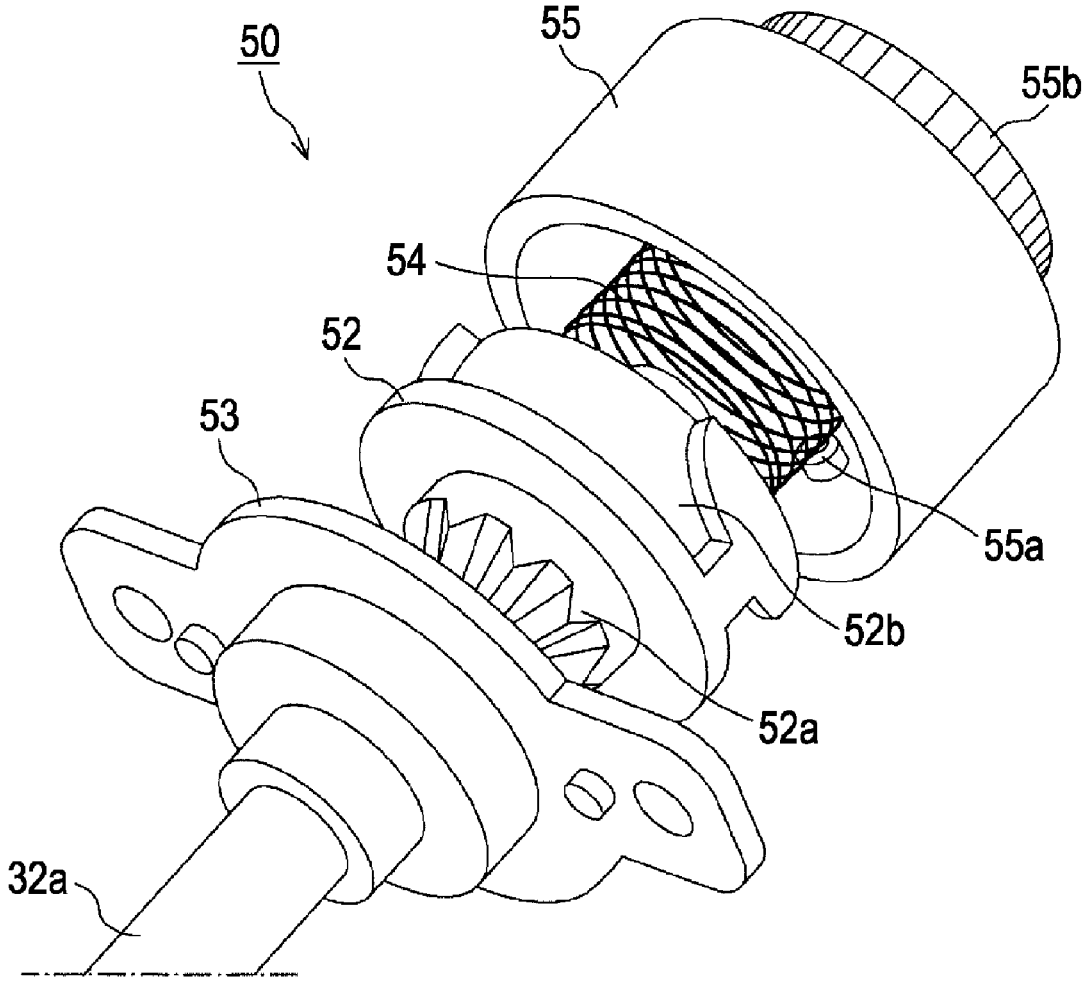
FIG. 10 is an exploded perspective view of a locking unit.
Figure 11:
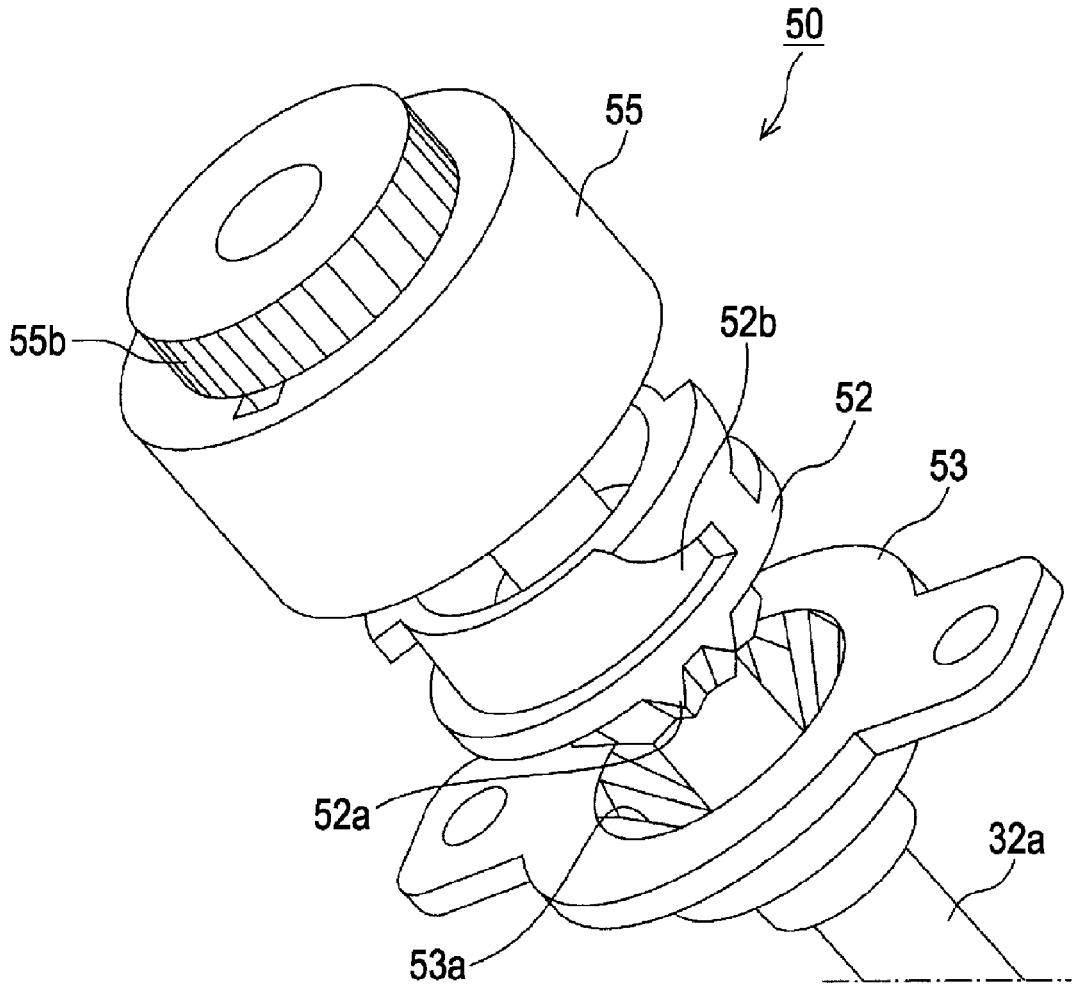
FIG. 11 is an exploded perspective view of a locking unit.
Figure 12:
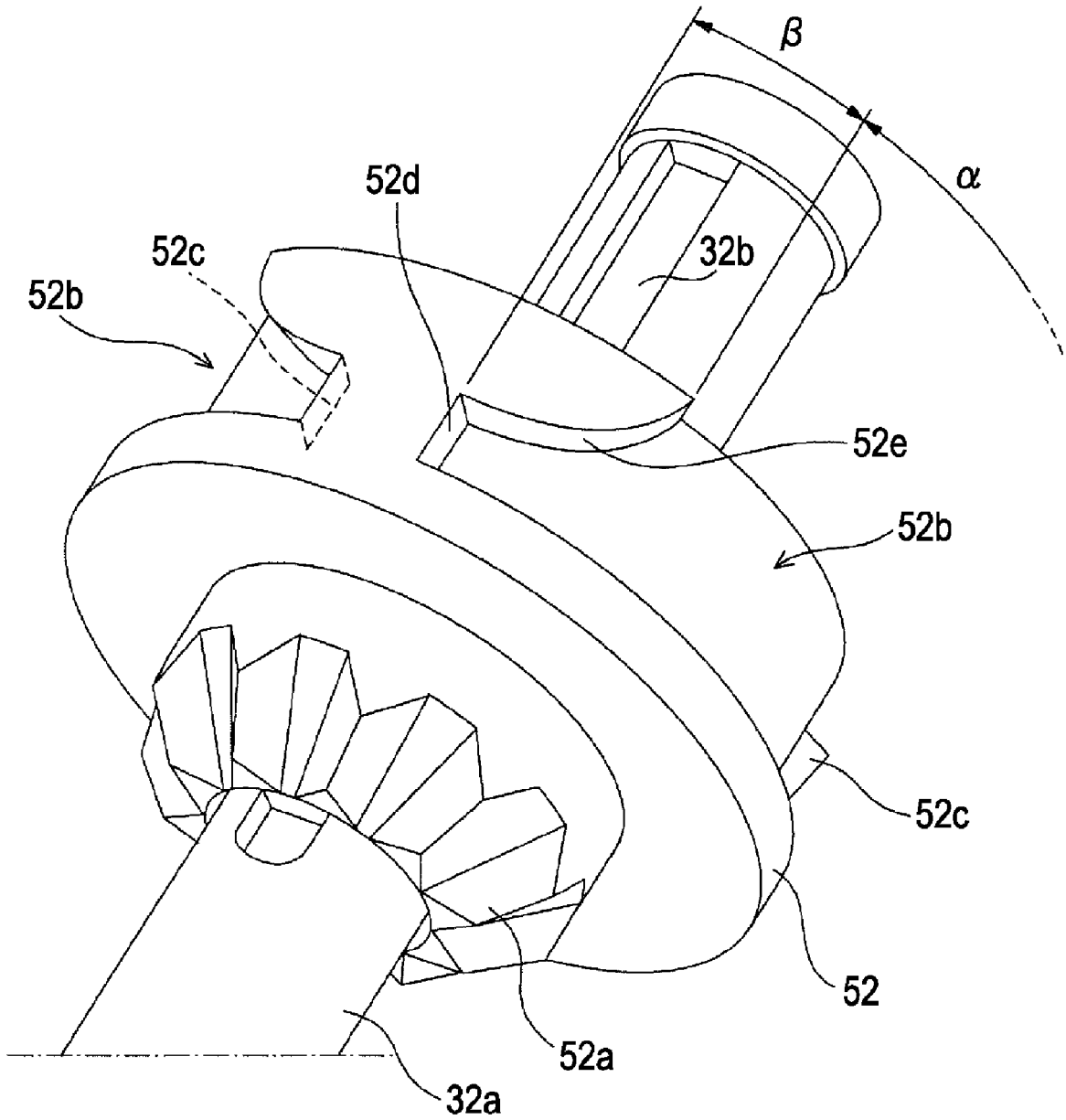
FIG. 12 is a perspective view of a rotary shaft and a clutch member.
Figure 13A:
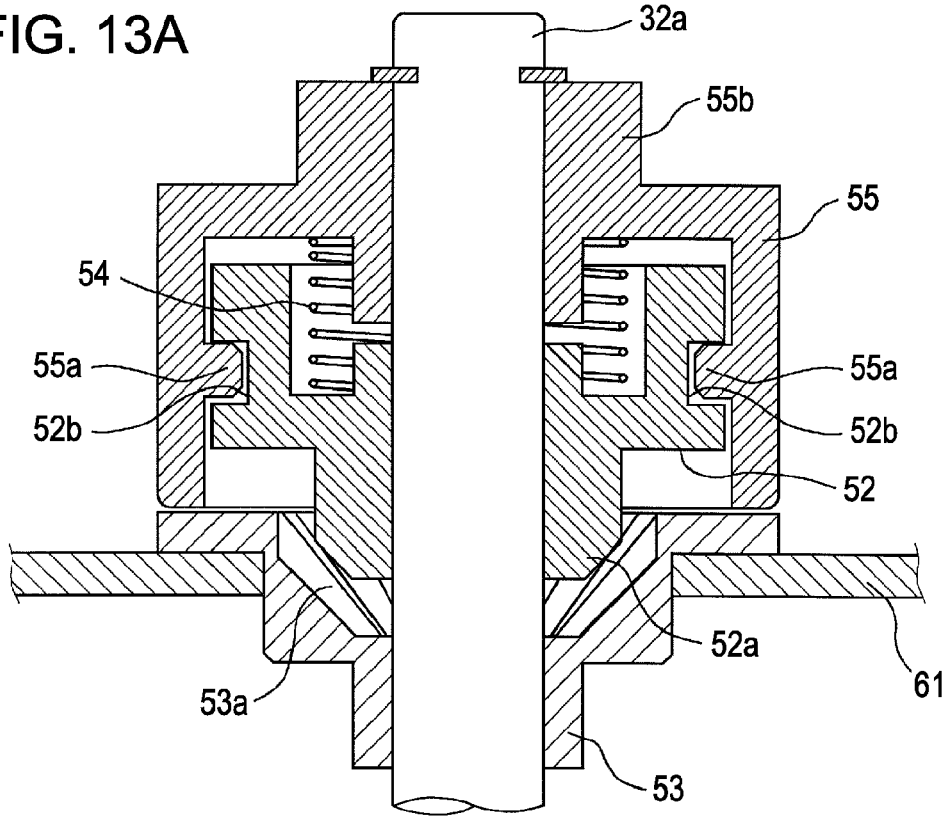
FIG. 13A is a sectional view of a locking unit taken along a plane parallel to the axis of a rotary shaft.
Figure 13B:
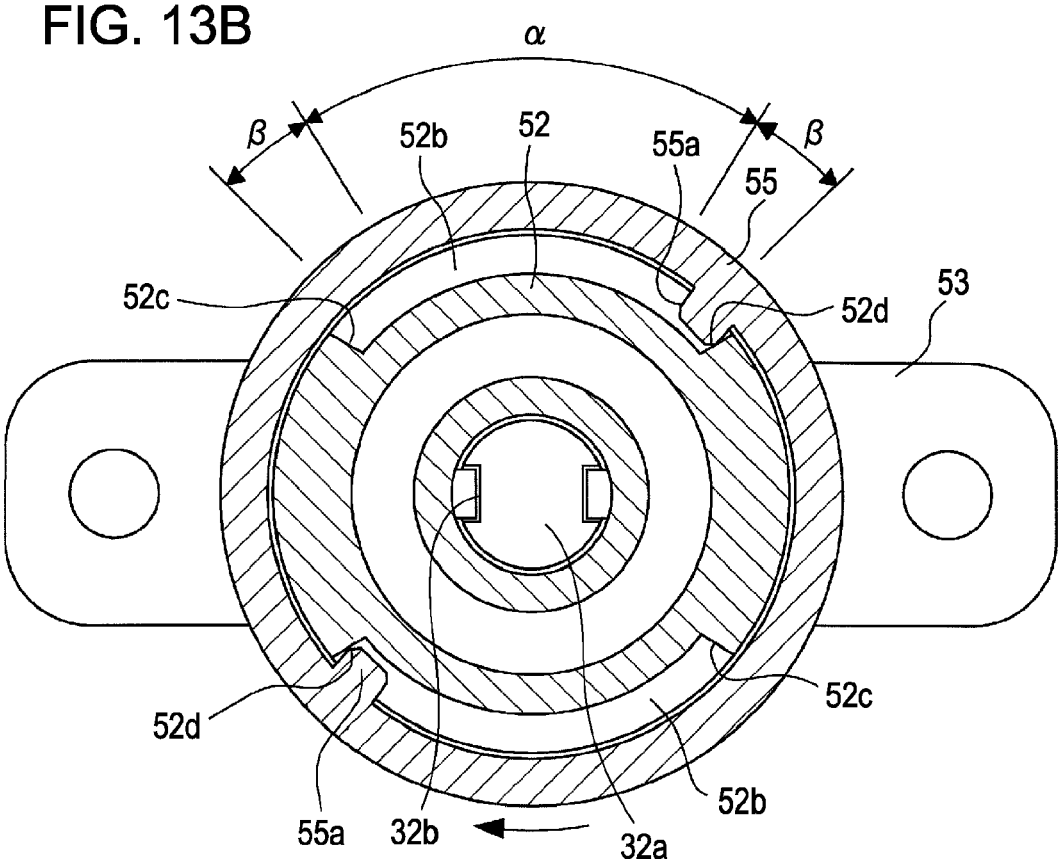
FIG. 13B is a sectional view of a locking unit taken along a plane perpendicular to the axis of a rotary shaft.
Figure 14A:
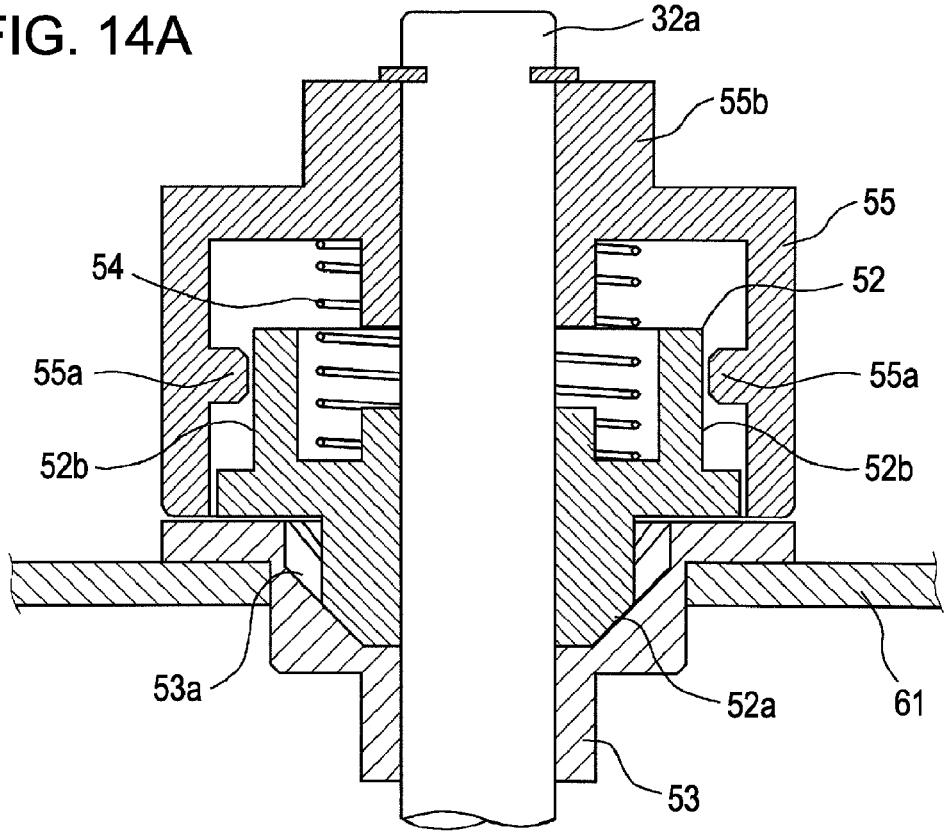
FIG. 14A is a sectional view of a locking unit taken along a plane parallel to the axis of a rotary shaft.
Figure 14B:
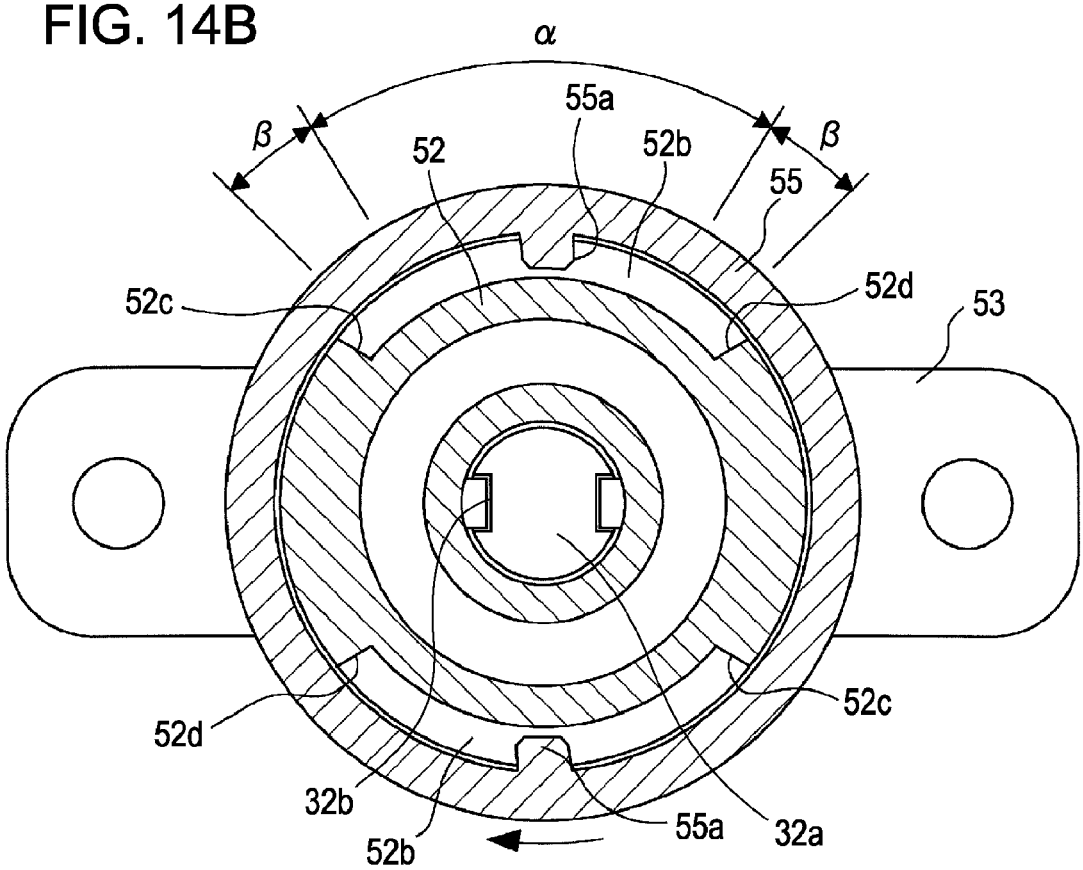
FIG. 14B is a sectional view of a locking unit taken along a plane perpendicular to the axis of a rotary shaft.
Figure 15A:
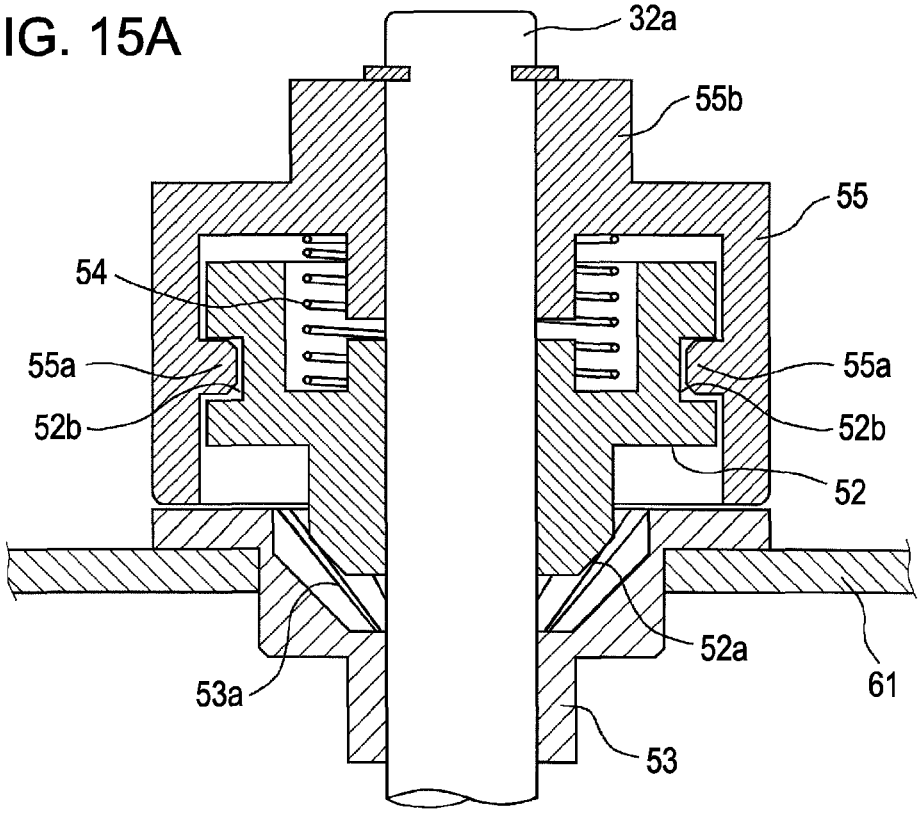
FIG. 15A is a sectional view of a locking unit taken along a plane parallel to the axis of a rotary shaft.
Figure 15B:
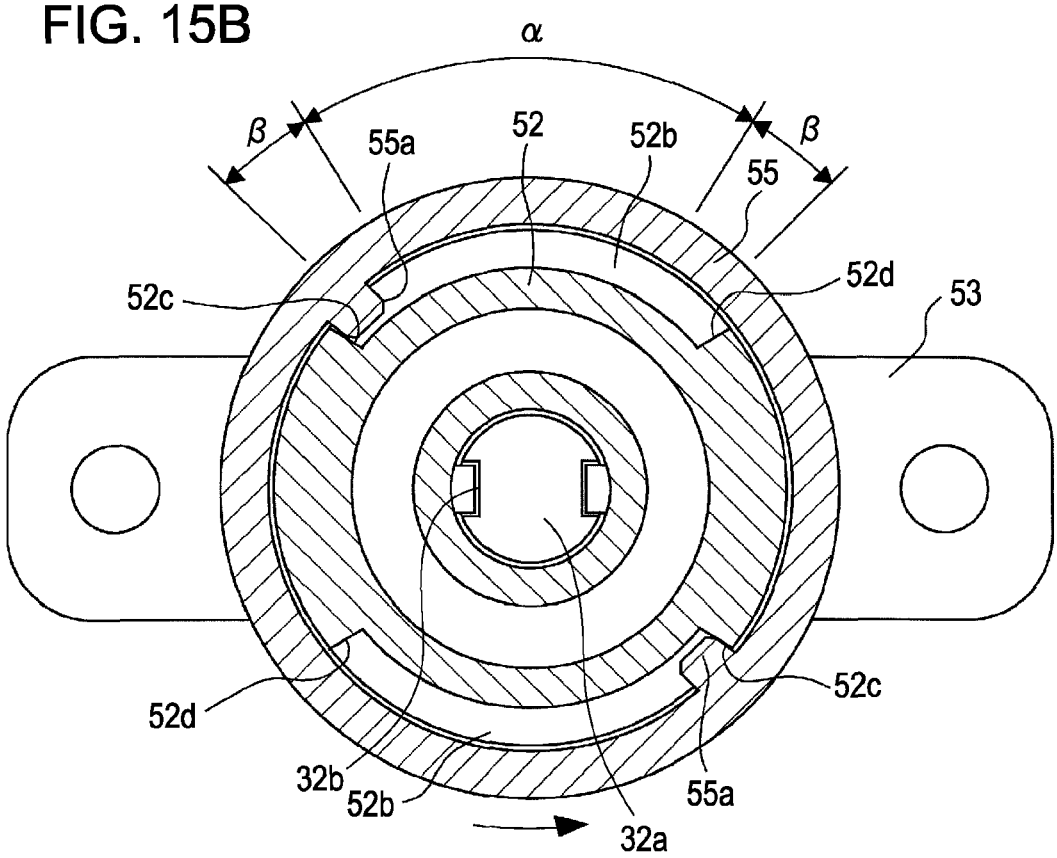
FIG. 15B is a sectional view of a locking unit taken along a plane perpendicular to the axis of a rotary shaft.

FIG. 9 is a front view of a locking device 8' according to a second embodiment of the invention. FIGS. 10 and 11 are exploded perspective views of a locking unit 50 according to a second embodiment of the invention. FIG. 12 is a perspective view of a rotary shaft 32*a* and a clutch member 52. FIGS. 13A, 14A, and 15A are sectional views of the locking unit 50 taken along a plane parallel to the axis of the rotary shaft 32*a*. FIGS. 13B, 14B, and 15B are sectional views of the locking unit 50 taken along a plane perpendicular to the axis of the rotary shaft 32*a*.

1. Configuration of Recording Apparatus

Hereinafter, the overall configuration of the printer 1 will be described in summary with reference to FIG. 1. In FIG. 1, in order to show rollers disposed on the sheet transport path of the printer 1, almost all of the rollers are shown on the same plane, but the positions of the rollers in a depth direction (in FIG. 1, a front-rear direction of the paper) are not necessarily aligned with each other (may be aligned with each other).

The printer 1 includes a feeding device 2 at its bottom. The printer 1 is configured such that recording sheets P serving as recording mediums are fed from the feeding device 2 one by one, a recording unit 4 performs ink jet recording on the recording sheet P, and the recording sheet P is discharged toward a sheet discharge stacker (not shown) provided on a front side of the apparatus (in FIG. 1, on a left side). The printer 1 is detachably provided with a both-sided unit 7 at a rear portion of the apparatus, such that a second side opposite an initially recorded first side of the sheet P is bent and inverted so as to be opposite the recording head 42, thereby performing recording on both sides of the sheet P.

Hereinafter, the respective constituent elements will be further described. The feeding device 2 includes a sheet cassette 11, a pickup roller 16, a guide roller 20, and a separation unit 21. The sheet cassette 11, in which a plurality of sheets P are stacked, is configured so as to be attached to and detached from a main body of the feeding device 2 from the front side of the apparatus. The pickup roller 16 that is rotated by a motor (not shown) is provided in a pivot member 17 that pivots around a pivot shaft 18, rotates in contact with the sheet stacked in the sheet cassette 11, and feeds an uppermost sheet P from the sheet cassette 11.

A separation member 12 is provided so as to be opposite the leading end of the sheet stacked in the sheet cassette 11. The leading end of the uppermost sheet P to be fed slides on the separation member 12 and is moved to a downstream side. In this way, the uppermost sheet P is primarily separated from a next sheet P. The guide roller 20 is provided on a downstream side from the separation member 12 to freely rotate, and the separation unit 21 is provided on a downstream side from the guide roller 20. The separation unit 21 includes a separation roller 22 and a driving roller 23 and secondarily separates the sheet P.

A first intermediate feed section 25 is provided on a downstream side from the separation unit 21. The first intermediate feed section 25 includes a driving roller 26 that is rotated by a motor (not shown), and an assist roller 27 that is rotated by the rotation of the driving roller 26 while the sheet P is nipped between the driving roller 26 and the assist roller 27. The first intermediate feed portion 25 further feeds the sheet P toward the downstream side. Reference numeral 29 denotes a driven roller that reduces a load when the sheet P passes through a curved and inverted path (in particular, when a trailing end of the sheet passes through the curved and inverted path).

A second intermediate feed section 31 is provided on a downstream side from the driven roller 29. The second intermediate feed section 31 includes a driving roller 32 that is rotated by a motor (not shown), and an assist roller 33 that is rotated by the rotation of the driving roller 32 while the sheet P is nipped between the driving roller 32 and the assist roller 33. The second intermediate feed section 31 further feeds the sheet P toward the downstream side.

The recording unit 4 is disposed on a downstream side from the second intermediate feed section 31. The recording unit 4 includes a transport unit 5, the recording head 42, and a sheet guide front 39, and a discharge unit 6. The transport unit 5 includes a transport driving roller 35 that is rotated by a motor (not shown), and a transport driven roller 36 that is supported by a sheet guide above 37 so as to be rotated by the rotation of the transport driving roller 35 while being pressed into contact with the transport driving roller 35. The transport unit 5 accurately feeds the sheet P to a position opposite to the recording head 42.

A skew of the recording sheet P fed from the feeding device 2 is removed by skew removal control using a nip and release method, in which a first feed roller and a second feed roller on an upstream side from the first feed roller are used. Specifically, the leading end of the recording sheet P is nipped between the transport driving roller 35 (first feed roller) and the transport driven roller 36 and is fed to the downstream side by a predetermined amount. Thereafter, the transport driving roller 35 rotates backward in a state where the upstream-side driving roller 32 (second feed roller) has stopped, and the leading end of the sheet is released to an upstream side from the transport driving roller 35. In this way, the leading end of the sheet follows a nip point between the transport driving roller 35 and the transport driven roller 36, and the skew is corrected.

The recording head 42 is provided at the bottom of a carriage 40. The carriage 40 is driven to reciprocate in a main scanning direction while being guided by a carriage guide shaft 41 extending in the main scanning direction (in FIG. 1, a front-rear direction of the paper). The sheet guide front 39 is provided at a position opposite the recording head 42. The sheet guide front 39 defines a distance between the sheet P and the recording head 42.

The discharge unit 6 provided on a downstream side from the sheet guide front 39 includes a discharge driving roller 44 that is rotated by a motor (not shown), and a discharge driven roller 45 that is in contact with the discharge driving roller 44 and is rotated by the rotation of the discharge driving roller 44. The sheet P recorded by the recording unit 4 is discharged to the stacker (not shown), which is provided on the front side of the apparatus, by the discharge unit 6.

The both-sided unit 7 includes a large-diameter inversion roller 46, and assist rollers 47 and 48 that are rotated by the rotation of the inversion roller 46 while the sheet P is nipped between the inversion roller 46 and the assist rollers 47 and 48. The sheet P that is fed from the sheet cassette 11 with the first side thereof recorded is led between the inversion roller 46 and the assist roller 48 by a backward feed operation of the second intermediate feed section 31, the transport unit 5, and the discharge unit 6 such that the trailing end of the sheet when the first side is recorded becomes the leading end.

The inversion roller 46 is rotated in a counterclockwise direction of FIG. 1 by a motor (not shown). The sheet that is led between the inversion roller 46 and the assist roller 48 passes between the inversion roller 46 and the assist roller 47, reaches the second intermediate feed section 31 again, and is guided to the recording unit 4. Thereafter, recording is performed in the same manner.

The pickup roller 16, the driving rollers 23, 26, and 32, the transport driving roller 35, the discharge driving roller 44, and the inversion roller 46 that are provided on the sheet transport path and driven to rotate are configured to be rotated by a common driving motor. Of these, a locking device according to an embodiment of the invention is provided between the driving roller 32 and the driving motor constituting the second intermediate feed section 31, such that the driving roller 32 is locked so as not to rotate as occasion demands.

2. First Embodiment of Locking Device

Hereinafter, a first embodiment of the invention will be described with reference to FIGS. 2 to 8B. In FIG. 2, reference numeral 61 denotes a side frame (constituting the base of the printer 1) forming a plane parallel to a sheet transport direction. The locking device 8 is provided in the side frame 61.

In FIG. 2, reference numeral 90 denotes a gear that is provided at an axial end of the transport driving roller 35. Rotary torque is transmitted from the gear 90 to the sun gear 94 constituting the locking device 8, and rotary torque is transmitted from the locking unit 70 constituting the locking device 8 to a gear 97. The gear 97 is attached to an axial end of the rotary shaft 32*a* of the driving roller 32. The locking device 8 is switched between an unlock state where the rotary shaft 32*a* is permitted to rotate and a lock state where the rotary shaft 32*a* is regulated to rotate.

On a left side from the gear 97 of FIG. 2, a gear wheel train (not shown) is further provided. Rotary torque of the transport driving roller 35 (driving motor) is further transmitted to an inversion device 7 (inversion roller 46) through the gear 97.

The configuration of the locking device 8 will be further described in detail. As shown in FIGS. 2 and 5, the locking device 8 includes a sun gear 94, a first planetary gear 95, a first planetary lever 77, a second planetary gear 96, a second planetary lever 78, and a locking unit 70. The locking unit 70 includes a gear 71, a clutch member 72, a locking member 73, a coil spring 74 serving as an urging member, and a torque transmission member 75.

The first planetary gear 95 and the second planetary gear 96 are rotatably supported by the first planetary lever 77 and the second planetary lever 78 that are configured to pivot around the rotation center of the sun gear 94. The first planetary gear 95 and the second planetary gear 96 are respectively meshed with the sun gear 94. The first planetary lever 77 and the second planetary lever 78 are pivoted by rotation of the sun gear 94 so as to planetarily move around the sun gear 94.

With this planetary movement, the first planetary gear 95 and the second planetary gear 96 are switched between a meshed position where one of them is meshed with a transmission gear 75*b* and an unmeshed position where the other one is separated from the transmission gear 75*b*. FIG. 2 shows a case in which the first planetary gear 95 is at the meshed position, and the second planetary gear 96 is at the unmeshed position. To the contrary, FIG. 4 shows a case in which the first planetary gear 95 is at the unmeshed position, and the second planetary gear 96 is at the meshed position. In this way, one of the first planetary gear 95 and the second planetary gear 96 is at the meshed position, and the other one is at the unmeshed position.

In this embodiment, for convenience, forward rotation refers to when the transport driving roller 35 (the gear 90) rotates in a clockwise direction of FIG. 2 (when the sheet P is transported to the downstream side), and backward rotation refers to when the transport driving roller 35 rotates in a counterclockwise direction of FIG. 2 (when the sheet P is transported to the upstream side).

The first planetary gear 95 is displaced to the meshed position in accordance with forward rotation of the transport driving roller 35 (rotation of the sun gear 94 in a first direction), as shown in FIG. 2, to thereby rotate the transmission gear 75*b* in the counterclockwise direction of FIG. 2. The first planetary gear 95 is displaced to the unmeshed position in accordance with backward rotation of transport driving roller 35 (rotation of the sun gear 94 in a second direction), as shown in FIG. 4. To the contrary, the second planetary gear 96 is displaced to the meshed position in accordance with backward rotation of the transport driving roller 35 (rotation of the sun gear 94 in the second direction), as shown in FIG. 4, to thereby rotate the transmission gear 75*b* in a clockwise direction of FIG. 4. The second planetary gear 96 is displaced to the unmeshed position in accordance with forward rotation of the transport driving roller 35 (rotation of the sun gear 94 in the first direction), as shown in FIG. 2.

In FIGS. 2 to 4, the gear 71 and the transmission gear 75*b* have the same outer diameter and concentrically rotate, and thus they are shown as overlapping each other. Actually, as shown in FIG. 5, the gear 71 is located on a near side of FIG. 2, and the transmission gear 75*b* is located on a deep side of FIG. 2. That is, in FIG. 2, the gear 71 is meshed only with the gear 97, but it is not meshed with the first planetary gear 95 and the second planetary gear 96 described below. The transmission gear 75*b* is meshed with only the first planetary gear 95 or the second planetary gear 96, and is not meshed with the gear 97.

Next, the locking unit 70 will be described. Schematically, the locking unit 70 permits rotation of the gear 71 (the rotary shaft 71*a*) and rotates gear 71 if the transmission gear 75*b* receives rotary torque from the first planetary gear 95 or the second planetary gear 96, and locks the gear 71 (the rotary shaft 71*a*) if transmission of rotary torque from the first planetary gear 95 or the second planetary gear 96 is cut off (the transmission gear 75*b* is not meshed with the first planetary gear 95 and the second planetary gear 96).

As shown in FIGS. 5, 7A, and 7B, the clutch member 72 has a hole 72*e* through which the rotary shaft 71*a* formed integrally with the gear 71 passes. The rotary shaft 71*a* has a cross shape in sectional view. The hole 72*e* into which the rotary shaft 71*a* is inserted has the same cross shape as the rotary shaft 71*a* so as to follow the sectional shape of the rotary shaft 71*a*. Accordingly, if the clutch member 72 rotates, the gear 71 receives rotary torque from the clutch member 72 and rotates integrally with the clutch member 72.

The rotary shaft 71*a* and the hole 72*e* are unconstrained to each other along the axis of the rotary shaft 71*a*. That is, the clutch member 72 is provided so as to be slidably displaced along the axis of the rotary shaft 71*a*.

The clutch member 72 is provided with a cam groove 72*b* at an outer circumferential portion thereof. When the locking device 8 has been assembled, mesh teeth 72*a* are formed so as to be opposite the locking member 73 (also see FIG. 6).

The rotary shaft 71*a* has a cross shape in sectional view before a leading end thereof, and the leading end of the rotary shaft 71*a* has a cylindrical shape. The locking member 73 is provided with a hole 73*b* in which the leading end of the rotary shaft 71*a* is rotatably received. When the locking device 8 has been assembled, mesh teeth 73*a* are formed so as to be opposite the mesh teeth 72*a* formed in the clutch member 72. The locking member 73 is provided so as to be fixed to the side frame 61.

The coil spring 74 is interposed between the gear 71 and the clutch member 72 to urge the clutch member 72 toward the locking member 73.

When the locking device 8 has been assembled, the torque transmission member 75 has a ring shape, in which the clutch member 72 is received, and is provided with the transmission gear 75*b* at an outer circumferential portion thereof as a single body. If the transmission gear 75*b* is meshed with the first planetary gear 95 or the second planetary gear 96, rotary torque from the driving motor is transmitted to the transmission gear 75*b* so as to rotate the transmission gear 75*b*.

As described above, the clutch member 72 is provided so as to rotate integrally with the rotary shaft 71*a* (the gear 71), and the torque transmission member 75 is configured to relatively rotate by a predetermined rotation angle with respect to the clutch member 72 and the rotary shaft 71*a* (the gear 71) (described below in detail).

Bosses 75*a* are formed at two opposing positions on an inner circumferential surface of the torque transmission member 75 at a phase interval of 180°. When the locking device 8 has been assembled, the bosses 75*a* are loosely inserted into cam grooves 72*b* (similarly to the bosses 75*a*, formed at two positions), which are formed in the clutch member 72, respectively, as indicated by a virtual line in FIG. 6.

Each of the cam grooves 72*b* has a shape that permits movement of the boss 75*a* within the cam groove in a circumferential direction of the boss 75*a* by a predetermined amount (rotation of the torque transmission member 75 by a predetermined amount), and permits movement of the boss 75*a* along the axis of the rotary shaft 71*a* (in an up-down direction of FIG. 6). Specifically, each of the cam grooves 72*b* has side walls 72*c* and 72*c* that individually form planes substantially perpendicular to the axis of the rotary shaft 71*a*, and slope surfaces 72*d* and 72*d* sloping with respect to the side walls 72*c* and 72*c*.

The operation of the locking unit 70 having the above-described configuration will be described with reference to FIGS. 7A and 7B. FIG. 7A shows a state where no rotary torque is transmitted from the first planetary gear 95 or the second planetary gear 96 to the torque transmission member 75 (the transmission gear 75*b*) (for example, a state where both the first planetary gear 95 and the second planetary gear 96 are not meshed with the gear 75*b*).

In this state, the clutch member 72 is engaged with the locking member 73 by an urging force of the coil spring 74, that is, the mesh teeth 72*a* of the clutch member 72 are meshed with the mesh teeth 73*a* of the locking member 73 (a state shown in FIG. 6).

Therefore, the clutch member 72 is put in the lock state where rotation is regulated. For this reason, even if an external force is applied to the rotary shaft 71*a* (the gear 71) to rotate the rotary shaft 71*a*, since the mesh teeth 72*a* are meshed with the mesh teeth 73*a*, the rotary shaft 71*a* (the gear 71) does not rotate. In this case, as shown in FIG. 6, the boss 75*a* formed in the torque transmission member 75 is disposed at an intersection of the slope surfaces 72*d* and 72*d*.

In this state, if rotary torque is transmitted from the first planetary gear 95 or the second planetary gear 96 to the torque transmission member 75 (the transmission gear 75*b*), the boss 75*a* is pressed against the slope surface 72*d* of the cam groove 72*b*, and pushes up the cam groove 72*b* (that is, the clutch member 72) toward an upper side of FIG. 6 against the urging force of the coil spring 74.

When this happens, as shown in FIG. 7B, the mesh teeth 72*a* of the clutch member 72 are unmeshed with the mesh teeth 73*a* of the locking member 73, that is, the clutch member 72 is put in the unlock state where rotation is permitted. Subsequently, if the torque transmission member 75 rotates, the boss 75*a* is moved from a contact position of the slope surface 72*d* of the cam groove 72*b* to a contact position of the side wall 72c, and presses the side wall 72*c*. Therefore, the torque transmission member 75, the clutch member 72, and the rotary shaft 71*a* (the gear 71) rotate as a single body.

In the locking unit 70, the cam grooves 72*b* are formed so as to be bilaterally symmetric. Therefore, if the transmission gear 75*b* (the torque transmission member 75) rotates in either direction, the lock state of FIG. 7A is switched to the unlock state of FIG. 7B. If the transmission gear 75*b* stops, the unlock state of FIG. 7B is switched to the lock state of FIG. 7A.

As described above, when the torque transmission member 75 is switched between rotation and stop, the boss 75*a* is displaced within the cam groove 72*b*. When this happens, the locking unit 70 is switched between the unlock state where rotation of the clutch member 72 (the rotary shaft 71*a* and the gear 71) is permitted and the lock state where rotation of the clutch member 72 is locked.

Next, the overall operation of the locking device 8 including the first planetary gear 95 and the second planetary gear 96 will be described. In FIG. 2, the first planetary lever 77 has a boss 77*a* on a side opposite the side frame 61. The boss 77*a* is loosely inserted into an arc-shaped guide groove 62 formed in the side frame 61, such that a pivotable range of the first planetary lever 77 is regulated by the guide groove 62.

Similarly, the second planetary lever 78 has a boss 7 8*a* on a side opposite the side frame 61. The boss 7 8*a* is loosely inserted into an arc-shaped guide groove 63 formed in the side frame 61, such that a pivotable range of the second planetary lever 78 is regulated by the guide groove 63.

Symbol (1 denotes a pivotable angle of the first planetary lever 77, and symbol (2 denotes a pivotable angle of the second planetary lever 78. As will be apparent from the drawing, in this embodiment, the condition (1<(2 is satisfied. Therefore, a displacement when the first planetary gear 95 is displaced between the meshed position and the unmeshed position is set so as to be smaller than a displacement when the second planetary gear 96 is displaced between the meshed position and the unmeshed position.

FIG. 2 shows a state where the transport driving roller 35 (the gear 90) is rotating forward. In this state, the first planetary gear 95 rotates the transmission gear 75*b* of the locking unit 70 in a direction of an arrow in FIG. 2, and the gear 71 of the locking unit 70 rotates the gear 97, that is, the driving roller 32 in a direction of the arrow in FIG. 2. That is, in this state, the recording sheet P can be transported from the upstream side to the downstream side.

In this state, if the transport driving roller 35 (the gear 90) rotates backward for the skew removal control using a nip and release method, as shown in FIG. 3, the first planetary gear 95 is separated from the transmission gear 75*b*, and the transmission gear 75*b* is not meshed with both the first planetary gear 95 and the second planetary gear 96. That is, the transmission gear 75*b* is put in a power cutoff state.

When this happens, the locking unit 70 is put in the lock state where the rotary shaft 71*a* (the gear 71) is locked so as not to rotate. In this case, while the driving roller 32 is locked by the locking unit 70 so as not to rotate, the downstream-side transport driving roller 35 is continuously driven to rotate backward. For this reason, the recording sheet P is bent between the driving roller 32 and the transport driving roller 35, and the leading end of the sheet is released to the upstream side of the transport driving roller 35. Thus, a skew is removed.

As shown in FIG. 4, if the second planetary gear 96 is displaced to the meshed position, and rotary torque is transmitted to the transmission gear 75*b*, the locking unit 70 unlocks the rotary shaft 71*b* (the gear 71), as described above. When this happens, rotary torque is transmitted to the rotary shaft 71*b* (the gear 71), and the driving roller 32 is driven to rotate backward.

As described above, the locking unit 70 locks the rotary shaft 71*b* (the gear 71, and consequently the driving roller 32) for a power cutoff time for which both the first planetary gear 95 and the second planetary gear 96 are not meshed with the transmission gear 75*b*.

The transport driving roller 35 (the gear 90) is switched from the state shown in FIG. 4 to forward rotation again. Meanwhile, the displacement until the first planetary gear 95 returns to the meshed position is set small. Therefore, after the transport driving roller 35 is switched from backward rotation to forward rotation, the driving roller 32 can rapidly start to rotate forward, without causing a large time lag.

A time for which the transport driving roller 35 rotates forward in a state where the driving roller 32 has stopped can be shortened. Therefore, the recording sheet P is stretched between the driving roller 32 and the transport driving roller 35, and thus a recording surface of the recording sheet P can be prevented from being damaged due to a slip between the driving roller 32 and the recording sheet P.

Hereinafter, the advantages of the locking device 8 having the above-described configuration will be described. When the skew removal control using a nip and release method is performed, the transport driving roller 35 rotates backward, and the leading end of the sheet is released to the upstream side from the transport driving roller 35. In this case, although the released sheet rotates the upstream driving roller 32 backward, the driving roller 32 is reliably locked. Therefore, the sheet is reliably bent between the transport driving roller 35 and the driving roller 32, and the skew is reliably eliminated.

That is, the driving roller 32 is configured to rotate forward and backward, and as occasion demands, to be reliably prevented from rotating backward (locked). Specifically, unlike a one-way clutch that simply permits rotation of the rotary shaft in one direction, the locking device 8 can satisfy forward and backward rotation, and as occasion demands, reliable backward rotation prevention (rotation lock).

When the transport driving roller 35 and the driving roller 32 use a common driving source, the skew removal control using a nip and release method may be performed by using both rollers. In this case, while the downstream-side transport driving roller 35 rotates backward by a predetermined amount, the upstream-side driving roller 32 needs to be locked so as not to rotate backward. This embodiment can cope with such a demand.

The displacement of the first planetary gear 95 is set to be different from the displacement of the second planetary gear 96, and the first planetary gear 95 can be rapidly displaced from the unmeshed position to the meshed position. Therefore, as described above, after the transport driving roller 35 is switched from backward rotation to forward rotation, the driving roller 32 can rapidly start to rotate forward, without causing a large time lag. As a result, the recording sheet P can be prevented from being damaged.

In this embodiment, the engagement portions of the clutch member 72 and the locking member 73 are formed by the mesh teeth, and as shown in FIG. 8A, the shape of each of the mesh teeth 72*a* and 73*a* is set such that a pressure angle with respect to a rotation direction Y1 and a pressure angle with respect to a rotation direction Y2 are both set to 0° (also see FIG. 6). With the mesh teeth, the clutch member 72 can be further reliably locked.

Like mesh teeth 72*a*' and 73*a*' of FIG. 8B, if the conditions $0°<\delta<90°$ and $0°<\delta 2<90°$ (where $\delta 1$ denotes the pressure angle with respect to the rotation direction Y1 and $\delta 2$ is the pressure angle with respect to the rotation direction Y2) are satisfied, the mesh teeth can be reliably prevented from colliding against each other when the mesh teeth are meshed with each other.

Like mesh teeth 72*a*" and 73*a*" of FIG. 8C, the pressure angle $\delta 1$ with respect to the rotation direction Y1 is set so as to satisfy the condition $0°<\delta 1<90°$, and the pressure angle $\delta 2$ with respect to the rotation direction Y2 is set to $\delta 2=0°$. With this configuration, the clutch member 72 can be further reliably locked in the rotation direction Y2. With respect to the rotation direction Y1, when the clutch member 72 is forcedly rotated by an external force, if rotary torque of a predetermined level or more is applied, the tooth surface is slippery, and thus the clutch member 72 can rotate.

Therefore, for example, in the case of the driving roller 32, if the rotation direction Y2 is set as a backward rotation direction, when the skew removal control using a nip and release method is performed, the driving roller 32 can be reliably prevented from rotating backward. If rotary torque of a predetermined level or more is applied in a forward rotation direction (the rotation direction Y1), the driving roller 32 rotates. As a result, this embodiment can cope with a case in which paper jam occurs and the sheet should be pulled out.

3. Second Embodiment of Locking Device

Hereinafter, a locking device 8' according to a second embodiment of the invention will be described with reference to FIG. 9 to 15B. In FIG. 9, the same constituent elements as those described with reference to FIG. 2 are represented by the same reference numerals, and descriptions thereof will be omitted.

The locking device 8' is different from the first embodiment in the position and configuration of the locking unit (represented by reference numeral 50). As shown in FIG. 9, rotary torque of the first planetary gear 95 or the second planetary gear 96 is transmitted to the locking unit 50 through a spur gear 93.

In FIG. 9, reference numeral 55*b* denotes a transmission gear corresponding to the transmission gear 75*b* of the first embodiment. Similarly to the locking unit 70, if the transmission gear 75*b* receives rotary torque from the first planetary gear 95 or the second planetary gear 96, the locking unit 50 transmits rotary torque to the rotary shaft 32*a* so as to rotate the rotary shaft 32*a*. If transmission of rotary torque from the first planetary gear 95 or the second planetary gear 96 is cut off, the locking unit 50 locks the rotary shaft 32*a*.

As shown in FIGS. 10 and 11, the locking unit 50 includes a clutch member 52, a locking member 53, a coil spring 54 serving as an urging member, and a torque transmission member 55. The clutch member 52, the locking member 53, the coil spring 54, and the torque transmission member 55 correspond to the clutch member 72, the locking member 73, the coil spring 74, and the torque transmission member 75 in the first embodiment. Each constituent element has the same function as the corresponding constituent element in the first embodiment.

The clutch member 52 is provided with a hole through which the rotary shaft 32*a* of the driving roller 32 passes. The clutch member 52 is provided so as to transmit rotary torque to the rotary shaft 32*a* through a key groove 32*b* (FIG. 12) formed in the rotary shaft 32*a*, that is, so as to rotate integrally with the rotary shaft 32*a*. The clutch member 52 is provided so as to be slidably displaced along the axis of the rotary shaft 32*a* while being guided to the key groove 32*b*, that is, to be unconstrained with respect to the axis of the rotary shaft 32*a*.

The clutch member 52 is provided with cam grooves 52*b* at an outer circumferential portion so as to extend in a circumferential direction. When the locking unit 50 has been assembled, mesh teeth 52*a* are formed so as to opposite the locking member 53.

The locking member 53 is provided with a hole through which the rotary shaft 32*a* passes. When the locking unit 50 has been assembled, mesh teeth 53*a* are formed so as to be opposite the mesh teeth 52*a* formed in the clutch member 52. The locking member 53 is provided so as to be fixed to the side frame 61.

The coil spring 54 is interposed between the torque transmission member 55 and the clutch member 52 to urge the clutch member 52 toward the locking member 53.

When the locking unit 50 has been assembled, the torque transmission member 55 has a cylindrical shape in which the coil spring 54 and the clutch member 52 are received, and is provided with a transmission gear 55*b* as a single body. If the transmission gear 55*b* is meshed with the gear 93 (FIG. 9), rotary torque from the driving motor is transmitted to the transmission gear 55*b*, to thereby rotate the rotary shaft 32*a* as a rotary shaft.

As described above, the clutch member 52 is provided so as to rotate the rotary shaft 32*a* as a single body, and the locking member 53 and the torque transmission member 55 are provided to rotate with respect to the rotary shaft 32*a*, unlike the clutch member 52.

Bosses 55*a* are formed at two opposing positions on an inner circumferential surface of the torque transmission member 55 at a phase interval of 180°. When the locking unit 50 has been assembled, the bosses 55*a* are loosely inserted into cam grooves 52*b* (similarly to the bosses 55*a*, formed at two positions), which are formed in the clutch member 52.

As shown in FIGS. 12, and 13A to 15B, each of the cam grooves 52*b* has a regulation release region a where relative movement of the corresponding boss 55*a* along the axis of the rotary shaft 32*a* is permitted, and regulation regions P that are provided on both sides of the regulation release region a to regulate the movement of the boss 55*a*. Therefore, when the boss 55*a* is in the regulation release region a, movement of the clutch member 52 along the axis of the rotary shaft 32*a* is permitted. When the boss 55*a* is in one of the regulation regions P, the movement of the clutch member 52 along the axis of the rotary shaft 32*a* is regulated.

The operation of the locking unit 50 having the above-described configuration will be described with reference to FIGS. 13A to 15B. FIGS. 13A and 13B show a state where rotary torque in a clockwise direction of FIG. 13B is transmitted to the torque transmission member 55. In this state, the boss 55*a* of the torque transmission member 55 is in the regulation region P of the cam groove 52*b*. Therefore, the boss 55*a* presses one end surface 52*d* of the cam groove 52*b* so as to transmit rotary torque to the clutch member 52.

In this case, as shown in FIG. 13A, the boss 55*a* separates the clutch member 52 from the locking member 53 against the urging force of the coil spring 54. The mesh teeth 52*a* of the clutch member 52 are not meshed with the mesh teeth 53*a* of the locking member 53. Therefore, the clutch member 52 is put in the unlock state where rotation is permitted. As a result, rotary torque is transmitted to the torque transmission member 55, the clutch member 52, and the rotary shaft 32*a* in that order, and thus the rotary shaft 32*a* (the driving roller 32) rotates.

In this state, if the rotation direction of the torque transmission member 55 is switched to a counterclockwise direction of FIG. 13B, as shown in FIG. 14B, the boss 55*a* moves to the regulation release region a of the cam groove 52*b*, such that the boss 55*a* does not transmit rotary torque to the clutch member 52.

In this case, as shown in FIG. 14A, the boss 55*a* permits displacement of the clutch member 52. For this reason, the clutch member 52 is engaged with the locking member 53 by the urging force of the coil spring 54, that is, the mesh teeth 52*a* of the clutch member 52 are meshed with the mesh teeth 53*a* of the locking member 53. Therefore, the clutch member 52 is put in the lock state where rotation is regulated. As a result, even if an external force is applied to the rotary shaft 32*a* (the driving roller 32) to rotate the rotary shaft 32*a*, since the mesh teeth 52*a* are meshed with the mesh teeth 53*a*, the rotary shaft 32*a* (the driving roller 32) does not rotate.

In this state, if the torque transmission member 55 further rotates in the counterclockwise direction of FIG. 14B, as shown in FIG. 15B, the boss 55*a* moves to the regulation region P of the cam groove 52*b*. Therefore, the boss 55*a* presses the other end surface 52*c* of the cam groove 52*b* so as to transmit rotary shaft to the clutch member 52.

In this case, as shown in FIG. 15A, the boss 55*a* separates the clutch member 52 from the locking member 53 against the urging force of the coil spring 54. For this reason, the mesh teeth 52*a* of the clutch member 52 are unmeshed with the mesh teeth 53*a* of the locking member 53. Therefore, the clutch member 52 is changed to the unlock state where rotation is permitted. As a result, rotary torque is transmitted to the torque transmission member 55, the clutch member 52, and the rotary shaft 32*a* in that order, and thus the rotary shaft 32*a* (the driving roller 32) rotates.

In this state, if the rotation direction of the torque transmission member 55 is switched again, the constituent elements operate in reverse order from that described above. That is, the unlock state shown in FIGS. 15A and 15B is switched to the lock state shown in FIGS. 14A and 14B, and then to the unlock state shown in FIGS. 13A and 13B.

In the unlock state shown in FIGS. 13A and 13B or FIGS. 15A and 15B, if the torque transmission member 55 stops to rotate, as shown in FIG. 12, a cam surface 52*e* in the regulation region P of the cam groove 52*b* is curved so as to guide the boss 55*a* to the regulation release region a. For this reason, the clutch member 52*a* (the rotary shaft 32a) slightly rotates and is then switched to the lock state shown in FIGS. 14A and 14B.

As described above, the boss 55*a* is displaced within the cam groove 52*b* when the rotation direction of the torque transmission member 55 is switched or when the torque transmission member 55 is switched between rotation and stop. Accordingly, the locking unit 50 is switched between the unlock state where the clutch member 52 (the rotary shaft 32*a*) is permitted to rotate, and the lock state where the clutch member 52 (the rotary shaft 32*a*) is locked.

Therefore, with the locking unit 50, in order to perform the skew removal control using a nip and release method, if the transport driving roller 35 is switched from forward rotation to backward rotation, the driving roller 32 is reliably locked so as not to rotate. As a result, the sheet is reliably bent between the transport driving roller 35 and the driving roller 32, and thus a skew is reliably eliminated.

Adjustment of a period in which the spur gear 93 is not meshed with both the first planetary gear 95 and the second planetary gear 96 (the displacements of the first planetary gear 95 and the second planetary gear 96) ensures adjustment of the duration of the lock state. In addition, adjustment of the shape of the cam groove 52*b* also ensures adjustment of the duration of the lock state. Specifically, adjustment of the length of the regulation release region a ensures adjustment of the duration of the lock state when the rotation direction of the torque transmission member 55 is switched. As a result, the period in which the driving roller 32 is locked can be further smoothly adjusted.

4. Amount of Backward Rotation in Skew Removal Control

Next, an embodiment of the skew removal control using a nip and release method will be described in detail with reference to FIGS. 16 to 19B. In this case, the locking device 8 according to the first embodiment of the invention is used.

Figure 16:
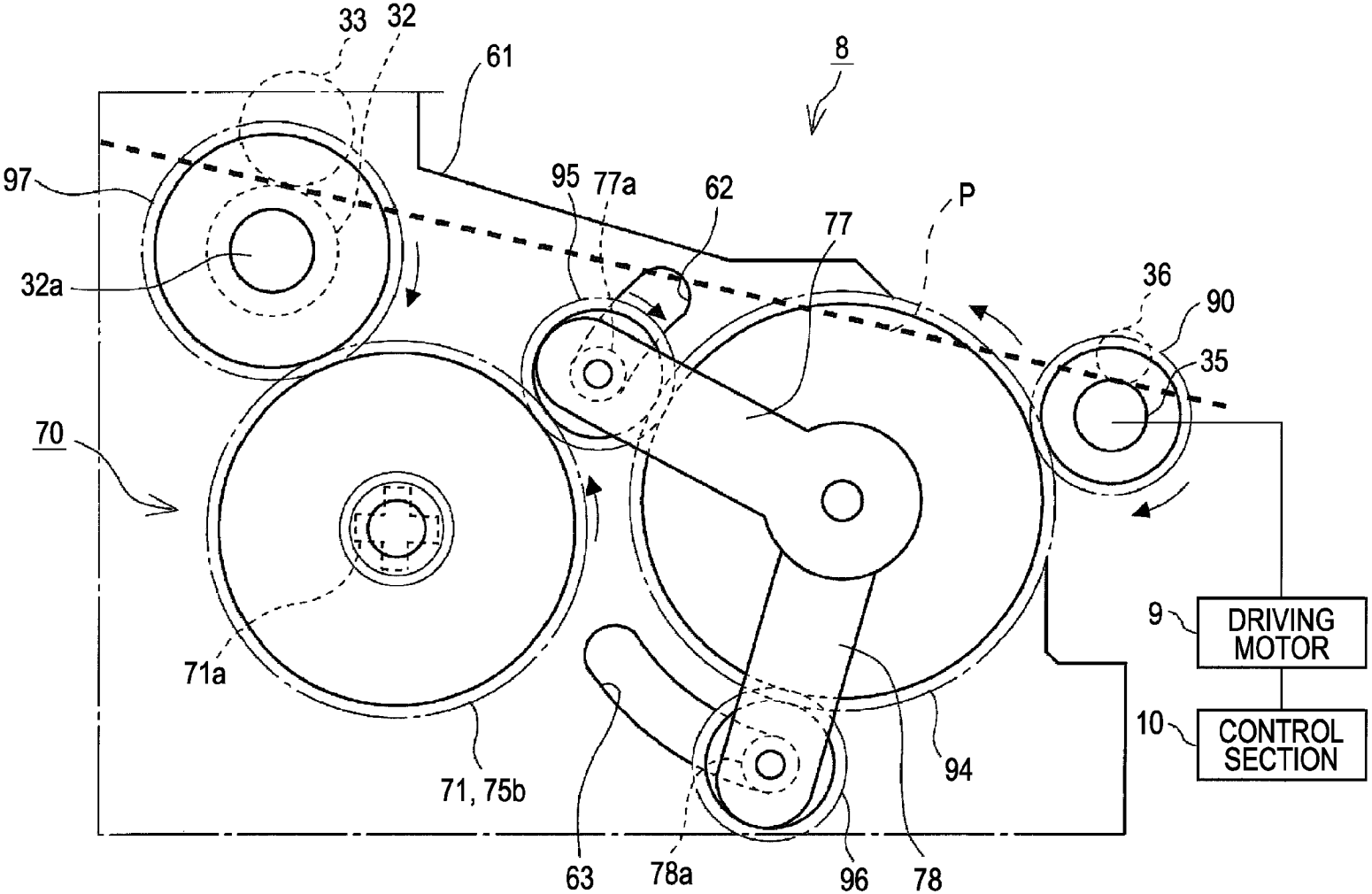
FIG. 16 is a front view of a locking device according to a first embodiment of the invention.
Figure 17:
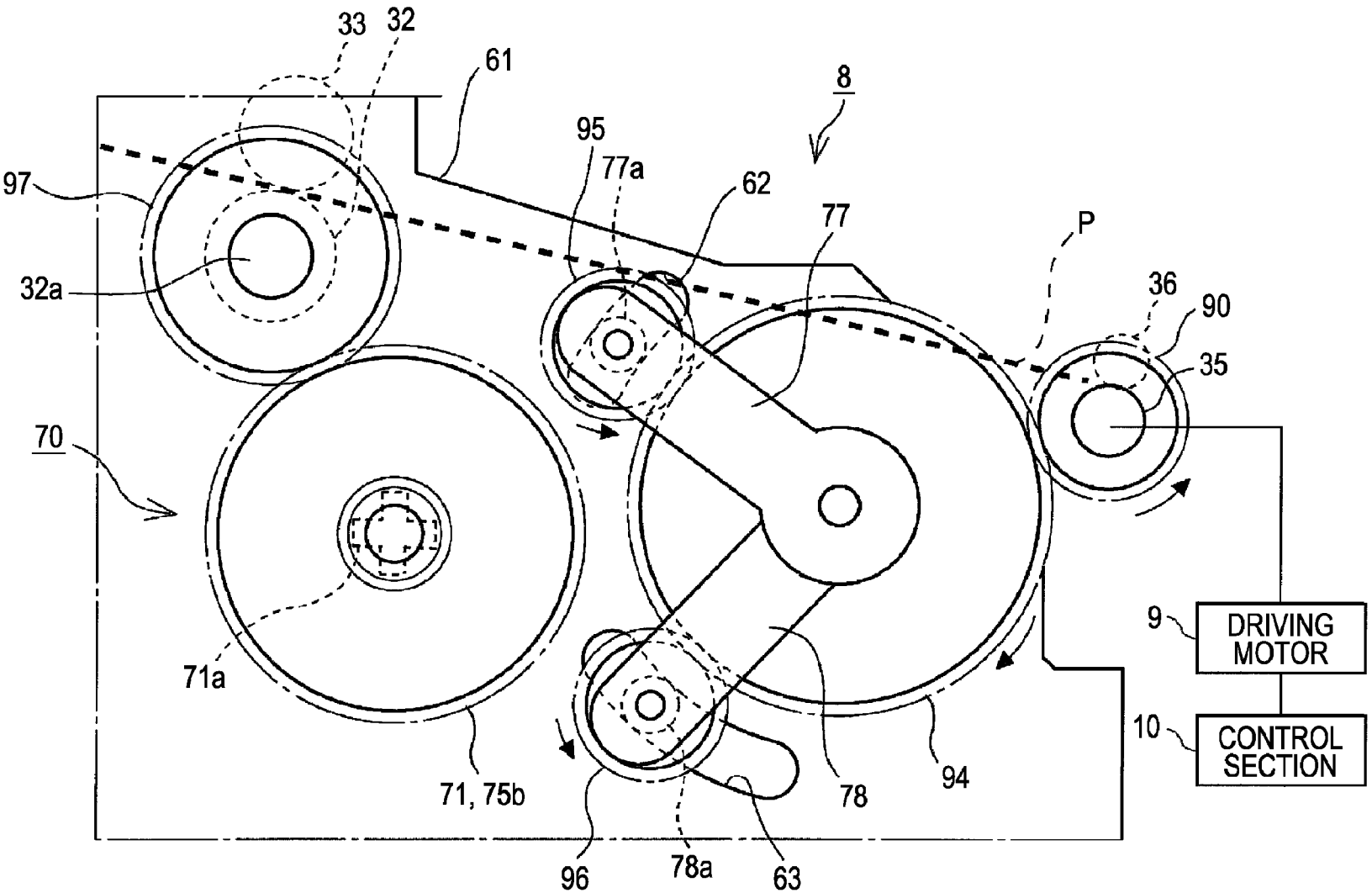
FIG. 17 is a front view of a locking device according to a first embodiment of the invention.
Figure 18:
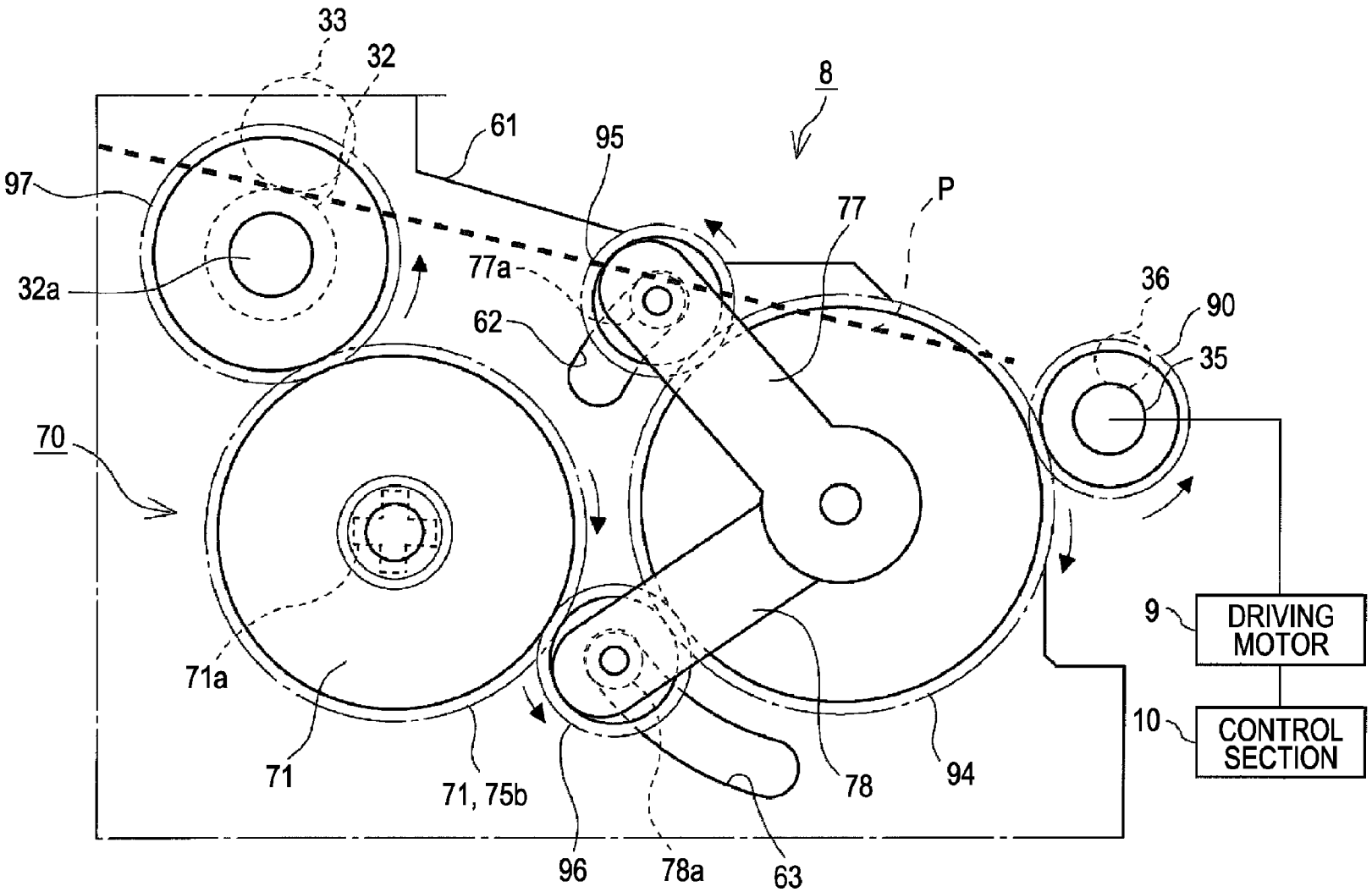
FIG. 18 is a front view of a locking device according to a first embodiment of the invention.
Figure 19A:
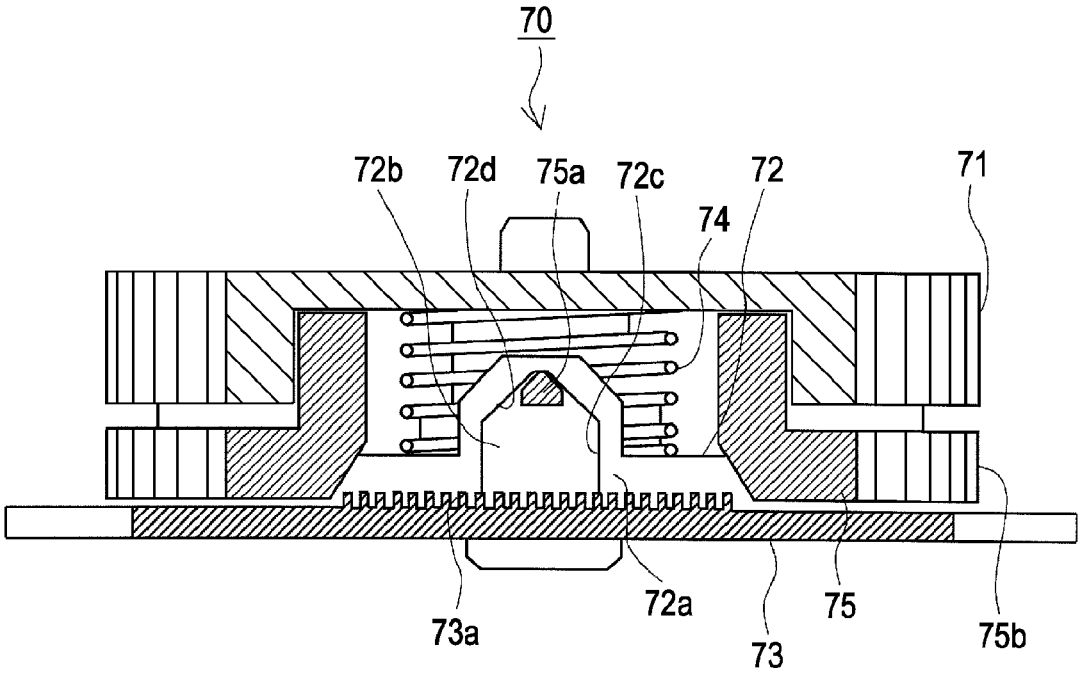
FIGS. 19A and 19B are sectional views of a locking unit.
Figure 19B:
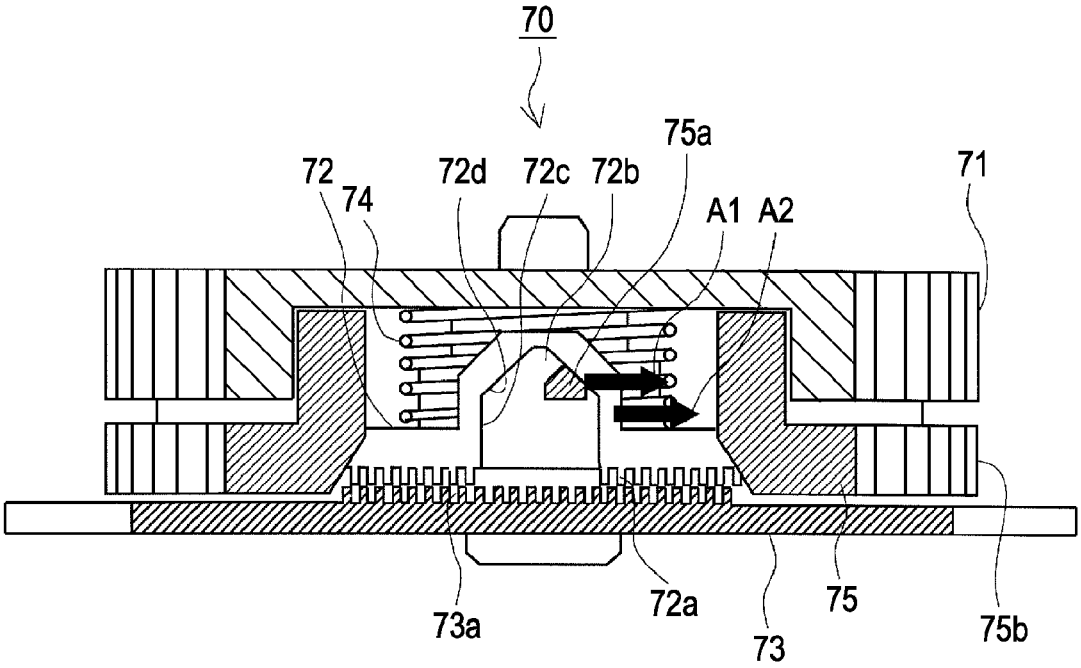

FIGS. 16 to 18 are front views of the locking device 8 according to the first embodiment of the invention shown in FIGS. 2 to 4. Unlike FIGS. 2 to 4, in FIGS. 16 to 18, the sheet P, the assist roller 33, and the transport driven roller 36 are represented by broken lines. Reference numeral 9 denotes a driving motor for driving the transport driving roller 35, and reference numeral 10 denotes a control section for controlling the driving motor 9. FIGS. 19A and 19B are sectional views of the locking unit 70 taken along the plane parallel to the axis of the rotary shaft (when the locking unit 70 shown in FIGS. 7A and 7B are viewed from the front side of the cam groove 72*b*).

As described above, the skew removal control using a nip and release method is performed by using a first feed roller (the transport driving roller 35) and a second feed roller (the driving roller 32) on an upstream side from the first feed roller. The skew removal control includes a first step, in which the driving motor 9 is driven to rotate forward so as to rotate the transport driving roller 35 and the upstream-side driving roller 32 forward, and as shown in FIG. 16, the leading end of the sheet is adjusted to the downstream side from the transport driving roller 35 by a predetermined amount, and a second step in which the driving motor 9 is switched to backward rotation so as to rotate the transport driving roller 35 backward while stopping the driving roller 32, and as shown in FIG. 17, the leading end of the sheet is released to the upstream side of the transport driving roller 32.

In the second step, when the transport driving roller 35 is driven to rotate backward, as shown in FIG. 17, the first planetary gear 95 is separated from the transmission gear 75*b*, and the transmission gear 75*b* is not meshed with both the first planetary gear 95 and the second planetary gear 96. That is, the transmission gear 75*b* is put in the power cutoff state. When this happens, while the locking unit 70 locks the driving roller 32 so as not to rotate, and the downstream-side transport driving roller 35 is continuously driven to rotate backward. Therefore, the sheet P is normally bent between the driving roller 32 and the transport driving roller 35, and the leading end of the sheet follows the transport driving roller 35 while being in contact with the transport driving roller 35. As a result, a skew is removed.

Meanwhile, when the sheet P is hard, such as a thick sheet or the like, even if the second step is executed, and as shown in FIG. 17, the sheet P may not be bent between the driving roller 32 and the transport driving roller 35, and may turn around the driving roller 32 and return to the upstream side directly. When the sheet P is hard, such as a thick sheet or the like, if the driving motor 9 is switched from forward rotation to backward rotation in the second step, the boss 75*a* moves in a left-right direction of FIG. 19B, and the sheet P turns around the driving roller 32. As a result, the cam groove 72*b* also moves simultaneously in the left-right direction of FIG. 19B. The movement of the cam groove 72*b* obstructs switching to the lock state. For this reason, the locking unit 70 permits the sheet P to turn around the driving roller 32.

In such a state, that is, a state where the sheet P is not bent between the driving roller 32 and the transport driving roller 35, and the leading end of the sheet is in contact between the transport driving roller 35 and the transport driven roller 36, if the driving motor 9 is switched to forward rotation again in order to transport the sheet P to the downstream side, the leading end of the sheet P is directly nipped between the transport driving roller 35 and the transport driven roller 36, and receives a force to feed the sheet P toward the downstream side.

Even if the driving motor 9 (the transport driving roller 35) is switched to forward rotation, it takes time until the first planetary gear 95 is displaced to the meshed position so as to be meshed with the transmission gear 75*b*, that is, it takes time until the upstream-side driving roller 32 starts to rotate forward. For this reason, the sheet P is stretched by the transport driving roller 35 that has precedingly started to rotate forward. In such a state, if the sheet P is transported, transport accuracy may be deteriorated.

In the locking device 8 according to this embodiment, as described above, although the displacement when the first planetary gear 95 is displaced from the unmeshed position to the meshed position is set so as to be smaller than the displacement of the second planetary gear 96, the transport driving roller 35 precedingly rotates forward to some extent until the first planetary gear 95 is displaced to the meshed position.

Therefore, in the skew removal control according to this embodiment, the backward rotation of the driving motor 9 (the transport driving roller 35) in the second step is executed until the second planetary gear 96 is displaced from the unmeshed position to the meshed position, as shown in FIG. 18, and both the transport driving roller 35 and the driving roller 32 rotate backward so as to return the leading end of the sheet to the upstream side from the transport driving roller 35.

Therefore, when the driving motor 9 (the transport driving roller 35) is switched to forward rotation subsequent to the second step, as described above, the leading end of the sheet is not directly nipped between the transport driving roller 35 and the transport driven roller 36. In addition, tension can be prevented from being applied to the sheet P between the transport driving roller 35 and the upstream-side driving roller 32 due to preceding forward rotation of the transport driving roller 35.

When the driving motor 9 is switched from backward rotation to forward rotation, the locking unit 70 is switched from the lock state shown in FIG. 19A to the unlock state shown in FIG. 19B. In this case, the boss 75*a* moves a direction of an arrow Al of FIG. 19B in accordance with forward rotation of the driving motor 9. In this case, if a force to feed the sheet P to the downstream side is applied to the sheet P by the downstream-side transport driving roller 35, the cam groove 72*b* (clutch member 72) also moves in a direction of an arrow A2 after lock release. For this reason, mesh teeth 72*a* and mesh teeth 73*a* are not sufficiently separated from each other, and contact noise (click) of them is generated.

In contrast, as described above, when the driving motor 9 is switched from backward rotation to forward rotation, the leading end of the sheet P is located on the upstream side from the transport driving roller 35 by a predetermined amount. For this reason, the cam groove 72*b* (the clutch member 72) can be prevented from moving in the direction of the arrow A2 in FIG. 19B after lock release, and thus contact noise (click) of the mesh teeth 72*a* and the mesh teeth 73*a* can be prevented from being generated since both cannot be sufficiently separated from each other.

What is claimed is:

1. A rotary shaft locking device comprising:

a locking unit having a transmission gear receiving rotary torque from a power source, transmitting rotary torque to a rotary shaft as the transmission gear receives rotary torque from the power source, and locking the rotary shaft as transmission of rotary torque from the power source is cut off; and a first planetary gear and a second planetary gear provided to be meshed with a sun gear and to planetarily move around the sun gear, and displaced between a meshed position and an unmeshed position so as to be meshed with and separated from the transmission gear by the planetary movement, wherein the first planetary gear is displaced to the meshed position in accordance with rotation of the sun gear in a first direction to thereby rotate the transmission gear, and is displaced to the unmeshed position in accordance with rotation of the sun gear in a second direction, the second planetary gear is displaced to the meshed position in accordance with rotation of the sun gear in the second direction, to thereby rotate the transmission gear in a direction opposite a rotation direction by the first planetary gear, and is displaced to the unmeshed position in accordance with rotation of the sun gear in the first direction, and the locking unit locks the rotary shaft for a power cutoff time which occurs when the rotation direction of the sun gear is switched and for which the transmission gear is not meshed with both the first planetary gear and the second planetary gear, wherein the locking unit comprises:

a clutch member provided to rotate integrally with the rotary shaft and to be displaced along the axis of the rotary shaft, a locking member provided in a fixed state to be engaged with the clutch member so as to regulate rotation of the clutch member, an urging member urging the clutch member toward the locking member, a torque transmission member having a boss integrally having the transmission gear, the boss being loosely inserted into a cam groove provided at an outer circumferential portion of the clutch member, and transmitting rotary torque to the clutch member through the boss, and the boss is displaced within the cam groove when the torque transmission member is switched between rotation and stop, such that an unlock state where the boss separates the clutch member from the locking member against an urging force of the urging member and a lock state where the boss permits displacement of the clutch member to engage the clutch member with the locking member are switched.

2. The rotary shaft locking device according to claim 1, wherein a displacement when the first planetary gear is displaced between the meshed position and the unmeshed position is different from a displacement when the second planetary gear is displaced between the meshed position and the unmeshed position.

3. A recording apparatus comprising:

a recording unit performing recording on a recording medium;

a first feed roller provided on an upstream side from the recording unit in a transport path of the recording medium to transport the recording medium toward the recording unit; and a second feed roller provided on an upstream side from the first feed roller in the transport path of the recording medium to transport the recording medium toward the first feed roller, wherein the first feed roller is driven to rotate by a driving motor, and a locking device provided for use by the first feed roller and the second feed roller, the locking device being configured to lock a rotary shaft of the second feed roller, the locking device comprising:

a locking unit having a transmission gear receiving rotary torque from a power source, transmitting rotary torque to a rotary shaft as the transmission gear receives rotary torque from the power source, and locking the rotary shaft as transmission of rotary torque from the power source is cut off, wherein the second feed roller is driven by the transmission gear; and a first planetary gear and a second planetary gear provided to be meshed with a sun gear and to planetarily move around the sun gear, and displaced between a meshed position and an unmeshed position so as to be meshed with and separated from the transmission gear by the planetary movement, wherein the first planetary gear is displaced to the meshed position in accordance with rotation of the sun gear in a first direction to thereby rotate the transmission gear, and is displaced to the unmeshed position in accordance with rotation of the sun gear in a second direction, the second planetary gear is displaced to the meshed position in accordance with rotation of the sun gear in the second direction, to thereby rotate the transmission gear in a direction opposite a rotation direction by the first planetary gear, and is displaced to the unmeshed position in accordance with rotation of the sun gear in the first direction, and the locking unit locks the rotary shaft for a power cutoff time which occurs when the rotation direction of the sun gear is switched and for which the transmission gear is not meshed with both the first planetary gear and the second planetary gear.

4. The recording apparatus according to claim 3, wherein the sun gear is configured to receive rotary torque from the driving motor through the first feed roller, when the first feed roller rotates forward to transport the recording medium toward the downstream side, rotary torque for forward rotation is transmitted to the second feed roller through the first planetary gear such that the second feed roller transports the recording medium toward the downstream side, and a displacement when the first planetary gear is displaced from the unmeshed position to the meshed position as the first feed roller is switched from backward rotation to forward rotation is set so as to be smaller than a displacement when the second planetary gear is displaced from the unmeshed position to the meshed position as the first feed roller is switched from forward rotation to backward rotation.

5. The recording apparatus according to claim 3, wherein skew removal control is executed that includes a first step, in which the first feed roller and the second feed roller are rotated forward by forward rotation of the driving motor, and the leading end of the recording medium is adjusted to the downstream side from the first feed roller by a predetermined amount, and a second step, in which the driving motor is switched from forward rotation to backward rotation, the first feed roller rotates backward in a state where the locking unit locks the rotary shaft of the second feed roller, and the leading end of the recording medium is released to the upstream side from the first feed roller, and in the second step, the driving motor rotates backward until the second planetary gear is displaced from the unmeshed position to the meshed position, and the first feed roller and the second feed roller rotate backward to return the leading end of the recording medium to the upstream side from the first feed roller by a predetermined amount.

* * * * *